US011730286B2

(12) United States Patent
Hardy

(10) Patent No.: US 11,730,286 B2
(45) Date of Patent: Aug. 22, 2023

(54) PRODUCT MANAGEMENT DISPLAY SYSTEM WITH TRACKLESS PUSHER MECHANISM

(71) Applicant: RTC Industries, Inc., Rolling Meadows, IL (US)

(72) Inventor: Stephen N. Hardy, Wadsworth, OH (US)

(73) Assignee: RTC Industries, Inc., Rolling Meadows, IL (US)

( * ) Notice: Subject to any disclaimer, the term of this patent is extended or adjusted under 35 U.S.C. 154(b) by 0 days.

(21) Appl. No.: 17/203,442

(22) Filed: Mar. 16, 2021

(65) Prior Publication Data

US 2021/0307541 A1 Oct. 7, 2021

Related U.S. Application Data

(60) Division of application No. 16/597,064, filed on Oct. 9, 2019, now Pat. No. 10,952,549, which is a (Continued)

(51) Int. Cl.
*A47F 5/00* (2006.01)
*A47B 57/58* (2006.01)
(Continued)

(52) U.S. Cl.
CPC ..... *A47F 5/005* (2013.01); *A47B 57/58* (2013.01); *A47B 57/583* (2013.01); *A47B 65/15* (2014.12);
(Continued)

(58) Field of Classification Search
CPC ..... A47B 57/586; A47B 57/588; A47B 96/04; A47B 73/00; A47B 57/58; A47B 65/15;
(Continued)

(56) References Cited

U.S. PATENT DOCUMENTS 153,227 A 7/1874 Walkee
154,940 A 9/1874 Adams
(Continued)

FOREIGN PATENT DOCUMENTS

AU 2012301697 A1 4/2014
AU 2012301707 A1 4/2014
(Continued)

OTHER PUBLICATIONS

Sep. 28, 2021—(KR) Office Action—App. No. 10-2021-7029851.
(Continued)

*Primary Examiner* — Jennifer E. Novosad
(74) *Attorney, Agent, or Firm* — Michael Best & Friedrich, LLP

(57) ABSTRACT

A product management display system for merchandising product on a shelf includes using a trackless pusher mechanism that travels along a surface on which product is placed. A plurality of thin dividers separate the product into rows. The dividers may be formed separately and attached and secured by being inserted into a plurality of grooves arranged along the lower surface and the forward and rear support posts of the product dispensing tray. The dividers are configured to self-adjust by laterally shifting within the grooves when the product is moved forward by the pusher to being loaded by an operator to allow the product to be positioned in a tight fitting manner to maximize the amount of product that can be accommodated horizontally across the tray. In addition, the dividers may have a bottom wall spaced from the surface with a support column that is inserted into an elongated pocket to provide the structural support for the divider.

20 Claims, 19 Drawing Sheets

Related U.S. Application Data continuation of application No. 16/009,644, filed on Jun. 15, 2018, now Pat. No. 10,448,756.

(60) Provisional application No. 62/573,468, filed on Oct. 17, 2017, provisional application No. 62/520,985, filed on Jun. 16, 2017.

(51) Int. Cl.
*A47B 65/00* (2006.01)
*A47F 1/12* (2006.01)
*A47F 7/00* (2006.01)
*A47F 7/28* (2006.01)

(52) U.S. Cl.
CPC ..... *A47F 1/126* (2013.01); *A47F 7/0007* (2013.01); *A47F 7/28* (2013.01)

(58) Field of Classification Search
CPC ... A47B 57/581; A47B 57/583; A47B 57/585; A47F 5/005; A47F 5/0056; A47F 5/0062; A47F 5/132; A47F 7/144; A47F 1/125; A47F 1/126; A47F 3/02; A47F 1/04; A47F 7/0007
USPC ..... 211/59.3, 184, 74, 119.003; 108/61, 60; 312/71, 61; 206/817; 221/227, 225, 279
See application file for complete search history.

(56) References Cited

U.S. PATENT DOCUMENTS 355,511 A 1/1887 Danner
431,373 A 7/1890 Mendenhall
436,704 A 9/1890 Green
452,673 A 5/1891 Hunter
551,642 A 12/1895 Kleine
607,890 A 7/1898 Smith
607,891 A 7/1898 Smith
632,231 A 9/1899 Blades
608,067 A 12/1905 Briggs
647,863 A 3/1907 Watts
927,988 A 7/1909 Massey
1,030,317 A 6/1912 Middaugh
1,156,140 A 10/1915 Hair
1,244,694 A 10/1917 Blood
1,271,508 A 7/1918 Hall
1,282,532 A 10/1918 Bochenek
1,674,359 A 6/1928 Frey
1,674,582 A 6/1928 Wheeler
1,682,580 A 8/1928 Pratt
1,703,987 A 3/1929 Butler
1,712,080 A 5/1929 Kelly
1,714,266 A 5/1929 Johnson
1,721,529 A 7/1929 Poindexter
1,734,031 A 11/1929 Carlston
1,753,453 A 4/1930 Van Valkenburgh
1,767,823 A 6/1930 Vanderveld et al.
1,786,392 A 12/1930 Kemp
1,814,191 A 7/1931 Seyl
1,821,350 A 9/1931 Levy
1,849,024 A 3/1932 McKee
1,901,365 A 3/1933 Field
1,910,516 A 5/1933 Basenberg
1,939,651 A 12/1933 Bales
1,940,048 A 12/1933 Cutler
1,964,597 A 6/1934 Rapellin
1,971,749 A 8/1934 Hamilton
1,991,102 A 2/1935 Kernaghan
2,013,284 A 9/1935 Michaud
2,057,627 A 10/1936 Ferris
2,076,941 A 4/1937 Farr
2,079,754 A 5/1937 Waxgiser
2,085,479 A 6/1937 Shaffer et al.
2,108,950 A 2/1938 Stober
2,110,299 A 3/1938 Hinkle
2,111,496 A 3/1938 Scriba
2,125,747 A 8/1938 Zadek
2,127,827 A 8/1938 Meyer
2,129,122 A 9/1938 Follett
2,134,606 A 10/1938 Hackworth et al.
2,160,050 A 5/1939 Wolf
2,176,466 A 10/1939 Meyer
2,185,605 A 1/1940 Murphy
2,218,444 A 10/1940 Vineyard
2,220,469 A 11/1940 Wouters
2,230,547 A 2/1941 Royer
2,284,849 A 6/1942 Schreyer
2,308,851 A 1/1943 Anderson
2,374,965 A 5/1945 Weston
2,433,788 A 12/1947 Schade
2,452,687 A 11/1948 Schade
2,472,567 A 6/1949 Bruen
2,483,769 A 10/1949 Hickey
2,499,088 A 2/1950 Brill
2,516,122 A 7/1950 Hughes
2,520,738 A 8/1950 Segal
2,522,896 A 9/1950 Rifkin
2,527,277 A 10/1950 Schade
2,529,826 A 11/1950 Walker
2,537,564 A 1/1951 Wolters et al.
2,538,165 A 1/1951 Randtke
2,538,908 A 1/1951 McKeehan
2,555,102 A 5/1951 Anderson
2,563,570 A 8/1951 Williams
2,574,870 A * 11/1951 Gunn ..... B42F 17/02 211/51
2,582,058 A 1/1952 Nabholz
2,634,855 A 4/1953 Mandel
2,637,324 A 5/1953 Segal
2,642,861 A 6/1953 Tvedt
2,652,154 A 9/1953 Stevens
2,670,853 A 3/1954 Schneider
2,678,045 A 5/1954 Erhard
2,730,825 A 1/1956 Wilds
2,732,952 A 1/1956 Skelton
2,738,881 A 3/1956 Michel
2,750,049 A 6/1956 Hunter
2,767,042 A 10/1956 Kesling
2,775,365 A 12/1956 Mestman
2,784,871 A 3/1957 Gabrielsen
2,828,178 A 3/1958 Dahlgren
2,843,131 A * 7/1958 Wolters ..... A47B 57/58 220/531
2,853,078 A 9/1958 Nabholz
2,876,780 A 3/1959 Vogel
2,889,055 A 6/1959 Weller et al.
2,893,596 A 7/1959 Gabrielsen
2,918,295 A 12/1959 Milner
2,934,212 A 4/1960 Jacobson
2,934,215 A 4/1960 Mogulescu et al.
2,948,403 A 8/1960 Vallez
2,964,154 A 12/1960 Erickson
3,027,017 A 3/1962 Luxeder
3,067,903 A 12/1962 Jones, Jr.
3,083,067 A 3/1963 Vos et al.
3,103,396 A 9/1963 Portnoy
3,110,402 A 11/1963 Mogulescu
3,121,494 A 2/1964 Berk
3,122,236 A 2/1964 Michiel
3,124,254 A 3/1964 Davidson
3,127,022 A 3/1964 French
3,149,729 A 9/1964 Smith
3,151,576 A 10/1964 Patterson
3,161,295 A 12/1964 Chesley
3,166,195 A 1/1965 Taber
3,269,558 A * 8/1966 Hess ..... A47B 57/58 211/184
3,285,429 A 11/1966 Propst
3,300,166 A 1/1967 Wojciechowski
3,308,961 A 3/1967 Chesley
3,308,964 A 3/1967 Pistone
3,331,337 A 7/1967 MacKay
3,348,732 A 10/1967 Shwarz

(56) References Cited

U.S. PATENT DOCUMENTS 3,405,716 A 10/1968 Cafiero
3,452,899 A 7/1969 Libberton
3,497,081 A 2/1970 Field
3,501,016 A 3/1970 Kenneth
3,501,019 A 3/1970 Armstrong
3,501,020 A 3/1970 Krikorian
3,512,652 A 5/1970 Armstrong
D219,058 S 10/1970 Kaczur
3,550,979 A 12/1970 Protzmann
3,598,246 A 8/1971 Galli
3,625,371 A 12/1971 Dill
3,652,154 A 3/1972 Gebel
3,667,826 A 6/1972 Wood
3,698,568 A 10/1972 Armstrong
3,709,371 A 1/1973 Luck
3,751,129 A 8/1973 Wright et al.
3,767,083 A 10/1973 Webb
3,776,388 A 12/1973 Mattheis
3,780,876 A 12/1973 Elkins
3,800,958 A 4/1974 Dorn
3,814,490 A 6/1974 Dean et al.
3,815,519 A 6/1974 Meyer
3,830,169 A 8/1974 Madey
3,836,008 A 9/1974 Mraz
3,848,745 A 11/1974 Smith
3,868,021 A 2/1975 Heinrich
3,869,045 A * 3/1975 Lear ..... B42F 17/02 211/11
3,870,156 A 3/1975 O'Neill
3,893,739 A 7/1975 Bernard
3,923,159 A 12/1975 Taylor et al.
3,942,682 A 3/1976 McKay
3,949,880 A 4/1976 Fortunato
3,960,273 A 6/1976 Weston
3,966,050 A 6/1976 Dahl
3,999,663 A 12/1976 Walter et al.
4,007,841 A 2/1977 Seipel
4,015,886 A 4/1977 Wickenberg
4,042,096 A 8/1977 Smith
4,084,699 A 4/1978 Koepke
4,106,668 A 8/1978 Gebhardt et al.
4,205,763 A 6/1980 Merl
4,266,355 A 5/1981 Moss
4,269,326 A 5/1981 Delbrouck
4,300,693 A 11/1981 Spamer
4,303,162 A 12/1981 Suttles
4,331,243 A 5/1982 Doll
4,351,439 A 9/1982 Taylor
4,366,904 A * 1/1983 Roskvist ..... B42F 17/12 206/425
4,378,872 A 4/1983 Brown
4,397,606 A 8/1983 Bruton
4,416,380 A 11/1983 Flum
4,437,572 A 3/1984 Hoffman
4,448,653 A 5/1984 Wegmann
4,454,948 A 6/1984 Spamer
4,454,949 A 6/1984 Flum
4,460,096 A 7/1984 Ricci
D275,058 S 8/1984 Flum
4,463,854 A 8/1984 MacKenzie
4,467,927 A 8/1984 Nathan
4,470,943 A 9/1984 Preis
4,476,985 A 10/1984 Norberg et al.
4,478,337 A 10/1984 Flum
4,482,066 A 11/1984 Dykstra
4,488,653 A 12/1984 Belokin
4,500,147 A 2/1985 Reister
4,504,100 A 3/1985 Chaumard
4,512,480 A * 4/1985 Evenson ..... B42F 17/12 108/60
4,525,882 A 7/1985 Stenberg
4,550,838 A 11/1985 Nathan et al.
4,588,093 A 5/1986 Field
4,589,349 A 5/1986 Gebhardt et al.
4,590,696 A 5/1986 Squitieri
4,593,823 A 6/1986 Fershko et al.
4,602,560 A 7/1986 Jacky
4,606,280 A 8/1986 Poulton et al.
4,610,491 A 9/1986 Freeman
4,615,276 A 10/1986 Garabedian
4,620,489 A 11/1986 Albano
4,629,072 A 12/1986 Loew
4,651,883 A 3/1987 Gullett et al.
4,685,574 A 8/1987 Young et al.
4,703,982 A 11/1987 Rock et al.
4,705,175 A 11/1987 Howard et al.
4,706,821 A 11/1987 Kohls et al.
4,712,694 A 12/1987 Breslow
4,724,968 A 2/1988 Wombacher
4,729,481 A 3/1988 Hawkinson et al.
4,730,741 A 3/1988 Jackie, III et al.
4,735,324 A 4/1988 Wilcek
4,742,936 A 5/1988 Rein
4,744,489 A 5/1988 Binder et al.
4,762,235 A 8/1988 Howard et al.
4,768,661 A 9/1988 Pfeifer
4,771,898 A 9/1988 Howard et al.
4,775,058 A 10/1988 Yatsko
4,776,472 A 10/1988 Rosen
4,790,037 A 12/1988 Phillips
4,801,025 A 1/1989 Flum et al.
4,809,855 A 3/1989 Bustos
4,821,894 A 4/1989 Dechirot
4,828,144 A 5/1989 Garrick
4,830,201 A 5/1989 Breslow
4,836,390 A 6/1989 Polvere
4,846,367 A 7/1989 Guigan et al.
4,883,169 A 11/1989 Flanagan, Jr.
4,887,724 A 12/1989 Pielechowski et al.
4,887,737 A 12/1989 Adenau
4,889,397 A 12/1989 Ryan
4,896,779 A 1/1990 Jureckson
4,899,668 A 2/1990 Valiulis
4,899,893 A 2/1990 Robertson
4,901,853 A 2/1990 Maryatt
4,901,869 A 2/1990 Hawkinson et al.
4,901,872 A 2/1990 Lang
4,907,707 A 3/1990 Crum
4,923,070 A 5/1990 Jackie et al.
4,934,645 A 6/1990 Breslow
4,944,924 A 7/1990 Mawhirt et al.
4,958,739 A 9/1990 Spamer
4,981,224 A 1/1991 Rushing
4,997,094 A 3/1991 Spamer et al.
5,012,936 A 5/1991 Crum
5,025,936 A 6/1991 Lamoureaux
5,027,957 A 7/1991 Skalski
5,054,629 A 10/1991 Breen
5,082,125 A 1/1992 Ninni
5,088,607 A 2/1992 Risafi et al.
5,110,192 A 5/1992 Lauterbach
5,111,942 A 5/1992 Bernardin
5,123,546 A 6/1992 Crum
5,131,563 A 7/1992 Yablans
5,148,927 A 9/1992 Gebka
5,159,753 A 11/1992 Torrence
5,161,702 A 11/1992 Skalski
5,161,704 A 11/1992 Valiulis
5,178,258 A 1/1993 Smalley et al.
5,183,166 A 2/1993 Belokin, Jr. et al.
5,190,186 A 3/1993 Yablans et al.
5,197,610 A 3/1993 Bustos
5,197,631 A 3/1993 Mishima
5,199,584 A 4/1993 Fowler et al.
5,203,463 A 4/1993 Gold
5,215,199 A 6/1993 Bejarano
5,221,011 A 6/1993 Coto
5,240,126 A 8/1993 Foster et al.
5,255,802 A 10/1993 Krinke et al.
5,265,738 A 11/1993 Yablans et al.
5,269,600 A 12/1993 Arreola et al.
5,295,596 A 3/1994 Squitieri
5,316,154 A 5/1994 Hajec, Jr.
5,322,668 A 6/1994 Fomasso

(56) References Cited

U.S. PATENT DOCUMENTS 5,341,945 A 8/1994 Gibson
5,351,839 A 10/1994 Beeler et al.
5,366,099 A 11/1994 Schmid
5,381,908 A 1/1995 Hepp
5,390,802 A 2/1995 Pappagallo et al.
5,397,006 A 3/1995 Terrell
5,397,016 A 3/1995 Torrence et al.
5,405,193 A 4/1995 Herrenbruck
5,408,775 A 4/1995 Abramson et al.
5,411,146 A 5/1995 Jarecki et al.
5,413,229 A 5/1995 Zuberbuhler et al.
5,415,297 A 5/1995 Klein et al.
5,419,066 A 5/1995 Harnois et al.
5,439,122 A 8/1995 Ramsay
5,450,968 A 9/1995 Bustos
5,450,969 A 9/1995 Johnson et al.
5,458,248 A 10/1995 Alain
5,464,105 A 11/1995 Mandeltort
5,469,975 A 11/1995 Fajnszlajn
5,469,976 A 11/1995 Burchell
5,489,031 A 2/1996 Carroll
5,505,315 A 4/1996 Carroll
5,531,336 A * 7/1996 Parham ..... A47F 5/005 211/183
5,542,552 A 8/1996 Yablans et al.
5,562,217 A * 10/1996 Salveson ..... A47F 1/126 211/175
5,577,337 A 11/1996 Lin
5,597,150 A 1/1997 Stein et al.
5,613,621 A 3/1997 Gervasi et al.
D378,888 S 4/1997 Bertilsson
5,615,780 A 4/1997 Nimetz et al.
5,634,564 A 6/1997 Spamer et al.
5,638,963 A 6/1997 Finnelly et al.
5,641,082 A 6/1997 Grainger
5,645,176 A * 7/1997 Jay ..... A47F 1/12 211/59.2
5,655,670 A 8/1997 Stuart
5,657,702 A 8/1997 Ribeyrolles
5,665,304 A 9/1997 Heinen et al.
5,671,851 A 9/1997 Johnson et al.
5,673,801 A 10/1997 Markson
D386,363 S 11/1997 Dardashti
5,682,824 A 11/1997 Visk
5,685,664 A * 11/1997 Parham ..... A47F 1/126 403/393
5,690,038 A 11/1997 Merit et al.
5,695,076 A 12/1997 Jay
5,695,077 A 12/1997 Jay
5,707,034 A 1/1998 Cotterill
5,711,432 A 1/1998 Stein et al.
5,720,230 A 2/1998 Mansfield
5,730,320 A 3/1998 David
5,738,019 A 4/1998 Parker
5,740,944 A 4/1998 Crawford
5,743,428 A 4/1998 Rankin, VI
5,746,328 A 5/1998 Beeler et al.
5,749,478 A 5/1998 Ellis
5,765,390 A 6/1998 Johnson et al.
5,788,090 A 8/1998 Kajiwara
5,803,276 A 9/1998 Vogler
5,806,690 A 9/1998 Johnson et al.
5,826,731 A 10/1998 Dardashti
5,839,588 A 11/1998 Hawkinson
5,848,709 A 12/1998 Gelphman et al.
5,855,281 A 1/1999 Rabas
5,855,283 A 1/1999 Johnson
D405,632 S 2/1999 Parham
5,865,324 A 2/1999 Jay et al.
5,868,367 A 2/1999 Smith
5,873,473 A 2/1999 Pater
5,873,489 A 2/1999 Ide et al.
5,878,895 A 3/1999 Springs
5,881,910 A 3/1999 Rein
5,884,782 A 3/1999 Dembicks
5,887,732 A 3/1999 Zimmer et al.
5,904,256 A 5/1999 Jay
5,906,283 A 5/1999 Kump et al.
5,944,201 A 8/1999 Babboni et al.
5,951,228 A 9/1999 Pfeiffer et al.
5,970,887 A 10/1999 Hardy
5,971,173 A 10/1999 Valiulis et al.
5,971,204 A * 10/1999 Apps ..... A47F 7/285 211/59.2
5,975,318 A 11/1999 Jay
5,992,652 A 11/1999 Springs
5,992,653 A 11/1999 Anderson et al.
6,003,690 A 12/1999 Allen et al.
6,006,678 A 12/1999 Merit et al.
6,007,248 A 12/1999 Fulterer
6,015,051 A 1/2000 Battaglia
6,021,908 A 2/2000 Mathews
6,023,024 A 2/2000 Stjerneby
6,026,984 A 2/2000 Perrin
6,035,569 A 3/2000 Nagel et al.
6,041,720 A 3/2000 Hardy
6,044,982 A 4/2000 Stuart
6,044,989 A 4/2000 Sosso
6,047,647 A 4/2000 Laraia, Jr.
6,053,338 A * 4/2000 Avery ..... A46B 15/0055 211/184
6,068,142 A * 5/2000 Primiano ..... A47F 1/12 211/183
6,076,670 A 6/2000 Yeranossian
6,082,556 A * 7/2000 Primiano ..... A47F 7/28 211/59.2
6,082,557 A 7/2000 Leahy
6,082,558 A 7/2000 Battaglia
6,089,385 A 7/2000 Nozawa
6,102,185 A 8/2000 Neuwirth et al.
6,112,938 A 9/2000 Apps
6,129,218 A 10/2000 Henry et al.
6,132,158 A 10/2000 Pfeiffer et al.
6,142,316 A * 11/2000 Harbour ..... A47F 1/12 211/59.2
6,142,317 A 11/2000 Merl
6,155,438 A 12/2000 Close
6,158,598 A 12/2000 Josefsson
6,164,462 A 12/2000 Mumford
6,164,491 A 12/2000 Bustos et al.
6,173,845 B1 1/2001 Higgins et al.
6,186,725 B1 2/2001 Konstant
6,189,734 B1 * 2/2001 Apps ..... A47F 1/12 211/59.2
6,209,731 B1 4/2001 Spamer et al.
6,209,733 B1 4/2001 Higgins et al.
6,226,910 B1 5/2001 Ireland
6,227,385 B1 5/2001 Nickerson
6,227,386 B1 5/2001 Close
6,234,325 B1 5/2001 Higgins et al.
6,234,326 B1 5/2001 Higgins et al.
6,234,328 B1 5/2001 Mason
6,237,784 B1 * 5/2001 Primiano ..... A47F 1/12 211/59.2
D445,615 S 7/2001 Burke
6,253,954 B1 7/2001 Yasaka
6,299,004 B1 10/2001 Thalenfeld et al.
6,305,559 B1 10/2001 Hardy
6,308,839 B1 10/2001 Steinberg et al.
6,309,034 B1 10/2001 Credle, Jr. et al.
6,311,852 B1 11/2001 Ireland
6,325,221 B2 * 12/2001 Parham ..... A47F 1/12 211/183
6,325,222 B1 * 12/2001 Avery ..... A46B 15/0055 211/184
6,330,758 B1 12/2001 Feibelman
6,354,446 B1 3/2002 Chang
6,357,606 B1 3/2002 Henry
6,357,985 B1 3/2002 Anzani et al.
6,375,015 B1 4/2002 Wingate
6,378,727 B1 4/2002 Dupuis et al.
6,382,431 B1 5/2002 Burke
6,390,310 B1 5/2002 Insalaco

(56) References Cited

U.S. PATENT DOCUMENTS 6,398,044 B1 6/2002 Robertson
6,401,942 B1 6/2002 Eckert
6,405,880 B1 6/2002 Webb
6,409,026 B2 6/2002 Watanabe
6,409,027 B1 6/2002 Chang et al.
6,409,028 B2 6/2002 Nickerson
6,419,100 B1 7/2002 Menz et al.
6,428,123 B1 8/2002 Lucht et al.
6,431,808 B1 8/2002 Lowrey et al.
6,435,359 B1 8/2002 Priminano
6,439,402 B2 8/2002 Robertson
6,454,107 B1 9/2002 Belanger et al.
6,464,089 B1 10/2002 Rankin, VI
6,471,053 B1 10/2002 Feibelman
6,471,081 B1 10/2002 Weiler
6,484,891 B2 11/2002 Burke
6,490,983 B1 12/2002 Nicholson et al.
6,497,326 B1 12/2002 Osawa
6,505,747 B1 1/2003 Robertson
6,523,664 B2 2/2003 Shaw et al.
6,523,702 B1 2/2003 Primiano et al.
6,523,703 B1 2/2003 Robertson
6,527,127 B2 3/2003 Dumontet
6,533,131 B2 3/2003 Bada
6,550,636 B2 4/2003 Simpson
6,553,702 B1 4/2003 Bacnik
6,554,143 B1 4/2003 Robertson
6,571,498 B1 6/2003 Cyrluk
6,598,754 B2 7/2003 Weiler
6,604,638 B1 8/2003 Primiano et al.
6,615,995 B2 9/2003 Primiano et al.
6,622,874 B1 9/2003 Hawkinson
6,637,604 B1 10/2003 Jay
6,648,151 B2 11/2003 Battaglia et al.
6,651,828 B2 11/2003 Dimattio et al.
6,655,536 B2 12/2003 Jo et al.
6,659,293 B1 12/2003 Smith
6,666,533 B1 12/2003 Stavros
D485,699 S 1/2004 Mueller et al.
6,679,033 B2 1/2004 Hart et al.
6,679,389 B1 * 1/2004 Robertson ..... A47F 1/12 211/183
6,688,567 B2 2/2004 Fast et al.
6,691,891 B2 2/2004 Maldonado
6,695,152 B1 * 2/2004 Fabrizio ..... A47F 1/12 211/175
6,715,621 B2 * 4/2004 Boron ..... A47F 1/12 211/175
6,719,152 B1 4/2004 Nagel et al.
6,722,509 B1 4/2004 Robertson et al.
6,739,461 B1 5/2004 Robinson
6,745,905 B2 6/2004 Bernstein
6,749,070 B2 6/2004 Corbett, Jr. et al.
6,749,084 B2 6/2004 Thompson
6,756,975 B1 6/2004 Kishida et al.
6,758,349 B1 7/2004 Kwap et al.
6,769,552 B1 8/2004 Thalenfeld
6,772,888 B2 8/2004 Burke
6,779,670 B2 * 8/2004 Primiano ..... A47F 1/12 211/175
6,786,341 B2 9/2004 Stinnett et al.
6,793,185 B2 9/2004 Joliey
6,796,445 B2 9/2004 Cyrluk
6,799,523 B1 10/2004 Cunha
6,820,753 B2 11/2004 Kurtz et al.
6,820,754 B2 11/2004 Ondrasik
6,823,997 B2 11/2004 Linden et al.
6,824,009 B2 11/2004 Hardy
6,830,146 B1 12/2004 Scully et al.
6,830,157 B2 12/2004 Robertson et al.
6,843,382 B2 1/2005 Kanouchi et al.
6,843,632 B1 1/2005 Hollander
6,860,046 B1 3/2005 Squitieri
6,866,156 B2 3/2005 Nagel et al.
6,867,824 B2 3/2005 Eiraku et al.
6,874,646 B2 4/2005 Jay
6,889,854 B2 5/2005 Burke
6,889,855 B2 5/2005 Nagel
6,902,285 B2 6/2005 Eiraku et al.
6,918,495 B1 7/2005 Hoy
6,918,736 B2 7/2005 Hart et al.
6,919,933 B2 7/2005 Zhang et al.
6,923,330 B1 8/2005 Nagel
6,929,133 B1 8/2005 Knapp, III et al.
6,948,900 B1 9/2005 Neuman
6,955,269 B2 10/2005 Menz
6,957,941 B2 10/2005 Hart et al.
6,962,260 B2 11/2005 Jay et al.
6,963,386 B2 11/2005 Poliakine et al.
6,964,235 B2 11/2005 Hardy
6,964,344 B1 11/2005 Kim
6,976,598 B2 12/2005 Engel
6,981,597 B2 1/2006 Cash
7,004,334 B2 2/2006 Walsh et al.
7,007,790 B2 3/2006 Brannon
7,028,450 B2 4/2006 Hart et al.
7,028,852 B2 4/2006 Johnson et al.
7,063,217 B2 6/2006 Burke
7,080,969 B2 7/2006 Hart et al.
7,083,054 B2 * 8/2006 Squitieri ..... A47F 1/12 211/184
7,086,541 B2 8/2006 Robertson
7,093,546 B2 8/2006 Hardy
7,104,026 B2 9/2006 Welborn et al.
7,104,410 B2 * 9/2006 Primiano ..... A47F 1/12 211/183
7,108,143 B1 9/2006 Lin
7,111,914 B2 9/2006 Avendano
7,114,606 B2 10/2006 Shaw et al.
7,124,898 B2 10/2006 Richter et al.
7,140,499 B2 11/2006 Burke
7,140,705 B2 11/2006 Dressendorfer et al.
7,150,365 B2 12/2006 Hardy et al.
7,152,536 B2 12/2006 Hardy
7,168,546 B2 1/2007 Plesh, Sr.
7,168,579 B2 1/2007 Richter et al.
7,182,209 B2 2/2007 Squitieri
7,195,123 B2 3/2007 Roslof et al.
7,198,340 B1 4/2007 Ertz
7,200,903 B2 4/2007 Shaw et al.
7,201,281 B1 4/2007 Welker
7,216,770 B2 5/2007 Mueller et al.
7,229,143 B2 6/2007 Gilman
7,293,663 B2 11/2007 Lavery, Jr.
7,299,934 B2 11/2007 Hardy et al.
7,318,532 B1 1/2008 Lee et al.
7,347,335 B2 3/2008 Rankin, VI et al.
7,357,469 B2 4/2008 Ertz
7,395,938 B2 7/2008 Merit et al.
7,398,876 B2 7/2008 Vestergaard
7,404,494 B2 7/2008 Hardy
7,419,062 B2 9/2008 Mason
7,424,957 B1 9/2008 Luberto
7,451,881 B2 11/2008 Hardy et al.
7,458,473 B1 12/2008 Mason
7,478,731 B1 1/2009 Mason
7,497,342 B2 3/2009 Hardy
7,500,571 B2 3/2009 Hawkinson
7,530,452 B2 5/2009 Vestergaard
7,621,409 B2 11/2009 Hardy et al.
7,626,913 B2 12/2009 Usami
7,631,771 B2 12/2009 Nagel et al.
7,641,057 B2 1/2010 Mueller et al.
7,681,743 B2 3/2010 Hanretty et al.
7,681,744 B2 3/2010 Johnson
7,686,185 B2 3/2010 Zychinski
D613,101 S 4/2010 Hardy
7,703,614 B2 4/2010 Schneider et al.
7,717,276 B2 5/2010 Alves
7,768,399 B2 8/2010 Hachmann et al.
7,784,623 B2 8/2010 Mueller et al.
7,784,644 B2 8/2010 Albert et al.
7,792,711 B2 9/2010 Swafford, Jr. et al.
7,815,060 B2 10/2010 Iellimo

(56) References Cited

U.S. PATENT DOCUMENTS 7,823,724 B2 11/2010 Mowe et al.
7,823,734 B2 11/2010 Hardy
7,828,158 B2 11/2010 Colelli et al.
7,854,333 B2 12/2010 Kottke et al.
7,882,969 B2 2/2011 Gerstner et al.
7,896,171 B2 3/2011 Battaglia
7,896,172 B1 3/2011 Hester
7,918,353 B1 4/2011 Luberto
7,931,156 B2 4/2011 Hardy
7,934,609 B2 5/2011 Alves et al.
7,954,635 B2 6/2011 Biondi et al.
7,980,398 B2 7/2011 Kahl et al.
7,993,088 B2 8/2011 Sonon et al.
8,016,139 B2 9/2011 Hanners et al.
8,025,162 B2 9/2011 Hardy
8,038,017 B2 10/2011 Close
8,038,018 B1 10/2011 Breitenbach et al.
8,066,128 B2 11/2011 Crawbuck et al.
8,096,427 B2 1/2012 Hardy
8,113,360 B2 2/2012 Olson
8,113,601 B2 2/2012 Hardy
D655,107 S 3/2012 Clark et al.
8,127,944 B2 3/2012 Hardy
8,162,154 B2 * 4/2012 Trulaske, Sr. ..... A47F 7/28 211/59.2
8,167,149 B2 5/2012 Wamsley et al.
8,177,076 B2 5/2012 Rataiczak, III et al.
8,215,520 B2 7/2012 Miller et al.
8,225,946 B2 7/2012 Yang et al.
8,240,486 B2 8/2012 Niederhuefner et al.
8,267,258 B2 9/2012 Allwright et al.
8,276,772 B2 10/2012 Kim
8,302,783 B1 11/2012 Harris et al.
8,312,999 B2 11/2012 Hardy
8,322,544 B2 12/2012 Hardy
8,333,285 B2 12/2012 Kiehnau et al.
8,342,340 B2 1/2013 Rataiczak, III et al.
8,360,253 B2 1/2013 Hardy
8,376,154 B2 2/2013 Sun
8,397,922 B2 3/2013 Kahl et al.
8,413,825 B2 4/2013 Spizman et al.
8,485,391 B2 7/2013 Vlastakis et al.
8,556,092 B2 10/2013 Valiulis et al.
8,573,379 B2 11/2013 Brugmann
8,579,123 B2 11/2013 Mueller et al.
8,622,227 B2 1/2014 Bird et al.
8,657,126 B1 2/2014 Loftin et al.
8,662,325 B2 3/2014 Davis et al.
8,739,984 B2 6/2014 Hardy
8,763,819 B2 7/2014 Theisen et al.
8,844,431 B2 9/2014 Davis et al.
8,863,963 B2 * 10/2014 Hardy ..... A47F 1/04 211/59.3
8,915,381 B2 12/2014 Brozak et al.
8,967,394 B2 3/2015 Hardy et al.
8,973,765 B2 3/2015 Wamsley et al.
8,978,904 B2 3/2015 Hardy
9,016,483 B2 4/2015 Howley
9,060,624 B2 6/2015 Hardy
9,107,516 B2 * 8/2015 Pichel ..... A47F 1/04
9,138,075 B2 9/2015 Hardy et al.
9,149,132 B2 10/2015 Hardy
9,173,504 B2 11/2015 Hardy
9,232,864 B2 1/2016 Hardy et al.
9,259,102 B2 2/2016 Hardy et al.
9,265,362 B2 2/2016 Hardy
9,380,889 B2 * 7/2016 Howard ..... A47F 7/0007
9,402,485 B2 8/2016 Hardy et al.
9,445,675 B1 9/2016 DeSena et al.
9,486,088 B2 11/2016 Hardy et al.
9,668,590 B1 6/2017 Bruegmann
9,713,394 B1 7/2017 Bruegmann
9,901,191 B1 2/2018 Schmidt
9,949,577 B2 4/2018 Botta et al.
10,092,114 B2 * 10/2018 Camello ..... A47F 3/02
10,111,539 B2 10/2018 Collette
10,123,637 B1 11/2018 DeSena et al.
10,368,657 B2 8/2019 Lilja et al.
10,448,756 B2 * 10/2019 Hardy ..... A47F 5/005
10,455,953 B2 * 10/2019 Lilja ..... A47F 5/0068
10,952,549 B2 * 3/2021 Hardy ..... A47B 57/583
11,058,232 B2 * 7/2021 Hardy ..... A47B 87/0223
2001/0002658 A1 6/2001 Parham
2001/0010302 A1 8/2001 Nickerson
2001/0017284 A1 8/2001 Watanabe
2001/0019032 A1 9/2001 Battaglia et al.
2001/0020604 A1 9/2001 Battaglia et al.
2001/0020606 A1 9/2001 Battaglia et al.
2001/0042706 A1 11/2001 Ryan et al.
2001/0045403 A1 11/2001 Robertson
2001/0054297 A1 12/2001 Credle et al.
2002/0036178 A1 3/2002 Tombu
2002/0046981 A1 4/2002 Amish
2002/0066706 A1 6/2002 Robertson
2002/0088762 A1 7/2002 Burke
2002/0108916 A1 8/2002 Nickerson
2002/0148794 A1 10/2002 Marihugh
2002/0170866 A1 11/2002 Johnson et al.
2002/0179553 A1 12/2002 Squitieri
2002/0182050 A1 12/2002 Hart et al.
2002/0189201 A1 12/2002 Hart et al.
2002/0189209 A1 12/2002 Hart et al.
2003/0000956 A1 1/2003 Maldonado
2003/0007859 A1 1/2003 Hart et al.
2003/0010732 A1 1/2003 Burke
2003/0024889 A1 2/2003 Dumontet
2003/0057167 A1 3/2003 Johnson et al.
2003/0061973 A1 4/2003 Bustos
2003/0066811 A1 4/2003 Dimattio et al.
2003/0080075 A1 5/2003 Primiano et al.
2003/0084827 A1 5/2003 Nicholson et al.
2003/0085187 A1 5/2003 Johnson et al.
2003/0106867 A1 6/2003 Caterinacci
2003/0132178 A1 7/2003 Jay et al.
2003/0132182 A1 7/2003 Jay
2003/0136750 A1 7/2003 Fujii et al.
2003/0141265 A1 7/2003 Jo et al.
2003/0150829 A1 8/2003 Linden et al.
2003/0168420 A1 9/2003 Primiano
2003/0201203 A1 10/2003 Fast et al.
2003/0217980 A1 11/2003 Johnson et al.
2003/0226815 A1 12/2003 Gaunt et al.
2004/0000528 A1 1/2004 Nagel
2004/0004046 A1 1/2004 Primiano et al.
2004/0011754 A1 1/2004 Zadak
2004/0020877 A1 2/2004 Boron
2004/0020879 A1 2/2004 Close
2004/0065631 A1 4/2004 Nagel
2004/0079715 A1 4/2004 Richter et al.
2004/0084390 A1 5/2004 Bernstein
2004/0094493 A1 5/2004 Higgins
2004/0104239 A1 6/2004 Black et al.
2004/0105556 A1 6/2004 Grove
2004/0118793 A1 6/2004 Burke
2004/0118795 A1 6/2004 Burke
2004/0140276 A1 7/2004 Waldron
2004/0140278 A1 7/2004 Mueller et al.
2004/0140279 A1 7/2004 Mueller et al.
2004/0178156 A1 9/2004 Knorring et al.
2004/0182805 A1 9/2004 Harper
2004/0200793 A1 10/2004 Hardy
2004/0206054 A1 10/2004 Welborn et al.
2004/0232092 A1 11/2004 Cash
2004/0245197 A1 12/2004 McElvaney
2004/0247422 A1 12/2004 Neumann et al.
2004/0255500 A1 12/2004 Fast et al.
2005/0035075 A1 2/2005 Walker
2005/0040123 A1 2/2005 Ali
2005/0072657 A1 4/2005 Lawless et al.
2005/0072747 A1 4/2005 Roslof et al.
2005/0076817 A1 4/2005 Boks et al.
2005/0077259 A1 4/2005 Menz
2005/0092702 A1 5/2005 Nagel
2005/0098515 A1 5/2005 Close

(56) References Cited

U.S. PATENT DOCUMENTS

2005/0127014 A1 6/2005 Richter et al.
2005/0133471 A1 6/2005 Squitieri
2005/0139560 A1 6/2005 Whiteside et al.
2005/0150847 A1 7/2005 Hawkinson
2005/0167377 A1* 8/2005 Robertson ..... A47F 1/126 211/59.3
2005/0188574 A1 9/2005 Lowry
2005/0189310 A1 9/2005 Richter et al.
2005/0199563 A1 9/2005 Richter et al.
2005/0199564 A1* 9/2005 Johnson ..... A47F 1/126 211/59.3
2005/0199565 A1 9/2005 Richter et al.
2005/0218094 A1 10/2005 Howerton et al.
2005/0224437 A1 10/2005 Lee
2005/0249577 A1 11/2005 Hart et al.
2005/0258113 A1 11/2005 Close et al.
2005/0263465 A1 12/2005 Chung
2005/0286700 A1 12/2005 Hardy
2006/0001337 A1 1/2006 Walburn
2006/0032827 A1* 2/2006 Phoy ..... A47F 5/0093 211/59.2
2006/0049122 A1 3/2006 Mueller et al.
2006/0049125 A1 3/2006 Stowell
2006/0096938 A1 5/2006 Kanou
2006/0104758 A1 5/2006 Hart et al.
2006/0163180 A1 7/2006 Rankin et al.
2006/0163272 A1 7/2006 Gamble
2006/0186064 A1 8/2006 Merit et al.
2006/0186065 A1 8/2006 Ciesick
2006/0186066 A1 8/2006 Johnson et al.
2006/0196840 A1 9/2006 Jay et al.
2006/0213852 A1 9/2006 Kwon
2006/0226095 A1 10/2006 Hardy
2006/0237381 A1 10/2006 Lockwood et al.
2006/0260518 A1 11/2006 Josefsson et al.
2006/0263192 A1 11/2006 Hart et al.
2006/0273053 A1 12/2006 Roslof et al.
2006/0283150 A1 12/2006 Hart et al.
2006/0283151 A1 12/2006 Welborn et al.
2007/0006885 A1 1/2007 Shultz et al.
2007/0029270 A1 2/2007 Hawkinson
2007/0068427 A1 3/2007 Burke
2007/0068885 A1 3/2007 Busto et al.
2007/0075028 A1 4/2007 Nagel et al.
2007/0108142 A1 5/2007 Medcalf et al.
2007/0108146 A1 5/2007 Nawrocki
2007/0119798 A1 5/2007 Hanretty
2007/0119799 A1 5/2007 Hanretty et al.
2007/0138114 A1 6/2007 Dumontet
2007/0170127 A1 7/2007 Johnson
2007/0175839 A1 8/2007 Schneider et al.
2007/0175844 A1 8/2007 Schneider
2007/0187344 A1 8/2007 Mueller et al.
2007/0194037 A1 8/2007 Close
2007/0251905 A1 11/2007 Trotta
2007/0256992 A1 11/2007 Olson
2007/0267364 A1 11/2007 Barkdoll
2007/0272634 A1 11/2007 Richter et al.
2007/0278164 A1 12/2007 Lang et al.
2008/0000859 A1 1/2008 Yang et al.
2008/0011696 A1 1/2008 Richter et al.
2008/0017598 A1 1/2008 Rataiczak et al.
2008/0129161 A1 6/2008 Menz et al.
2008/0142458 A1 6/2008 Medcalf
2008/0156751 A1 7/2008 Richter et al.
2008/0156752 A1 7/2008 Bryson et al.
2008/0164229 A1 7/2008 Richter et al.
2008/0250986 A1 10/2008 Boon
2008/0295976 A1 12/2008 Watanabe
2008/0296241 A1 12/2008 Alves et al.
2008/0302742 A1 12/2008 Fulmer
2008/0314852 A1 12/2008 Richter et al.
2009/0020548 A1 1/2009 VanDruff
2009/0057254 A1 3/2009 Crawbuck et al.
2009/0065452 A1 3/2009 Smith
2009/0084745 A1 4/2009 Goehring
2009/0084812 A1 4/2009 Kirschner
2009/0101606 A1 4/2009 Olson
2009/0223914 A1* 9/2009 Kahl ..... A47F 7/285 211/59.2
2009/0248198 A1 10/2009 Siegel et al.
2009/0272705 A1 11/2009 Francis
2009/0277853 A1 11/2009 Bauer
2009/0278009 A1 11/2009 Nono et al.
2010/0012602 A1 1/2010 Valiulis et al.
2010/0065523 A1 3/2010 Northrup, Jr. et al.
2010/0072152 A1 3/2010 Kim
2010/0072154 A1 3/2010 Johnson
2010/0078402 A1 4/2010 Davis et al.
2010/0089847 A1 4/2010 Rataiczak, III et al.
2010/0096345 A1 4/2010 Crawbuck et al.
2010/0107670 A1 5/2010 Kottke et al.
2010/0108624 A1 5/2010 Sparkowski
2010/0133214 A1 6/2010 Evans
2010/0176075 A1 7/2010 Nagel et al.
2010/0181273 A1 7/2010 Nagel et al.
2010/0200526 A1 8/2010 Barkdoll
2010/0206829 A1 8/2010 Clements et al.
2010/0252519 A1 10/2010 Hanners et al.
2010/0258513 A1 10/2010 Meyer et al.
2010/0276383 A1 11/2010 Hardy
2011/0094980 A1* 4/2011 Cousin ..... A47F 5/005 211/59.2
2011/0121022 A1 5/2011 Shell et al.
2011/0147323 A1 6/2011 Sainato et al.
2011/0168652 A1 7/2011 Barkdoll
2011/0174750 A1 7/2011 Poulokefalos
2011/0204012 A1 8/2011 Eguchi et al.
2011/0215060 A1 9/2011 Niederhuefner
2011/0218889 A1 9/2011 Westberg et al.
2011/0220597 A1 9/2011 Sherretts et al.
2011/0284571 A1 11/2011 Lockwood et al.
2011/0304316 A1 12/2011 Hachmann et al.
2011/0315706 A1* 12/2011 Lockwood ..... B65D 83/00 221/155
2012/0048817 A1 3/2012 Green et al.
2012/0074088 A1 3/2012 Dotson et al.
2012/0090208 A1 4/2012 Grant
2012/0091162 A1 4/2012 Overhultz et al.
2012/0118840 A1 5/2012 Howley
2012/0204458 A1 8/2012 Goehring
2012/0217212 A1 8/2012 Czalkiewicz et al.
2012/0255922 A1 10/2012 Bryson et al.
2012/0285916 A1 11/2012 O'Quinn et al.
2012/0325764 A1 12/2012 Gerkensmeier et al.
2013/0015155 A1 1/2013 Brugmann
2013/0026117 A1 1/2013 Hardy
2013/0037562 A1 2/2013 Close
2013/0153524 A1 6/2013 Nilsson
2013/0200019 A1 8/2013 Hardy et al.
2013/0200026 A1 8/2013 Bryson et al.
2013/0206713 A1 8/2013 Hardy
2013/0213916 A1 8/2013 Leahy et al.
2013/0248475 A1 9/2013 Erickson
2013/0270204 A1 10/2013 Bird et al.
2014/0008382 A1 1/2014 Christianson
2014/0091696 A1 4/2014 Welker et al.
2014/0124463 A1 5/2014 Goehring
2014/0138330 A1 5/2014 Hardy
2014/0144854 A1 5/2014 Burchell
2014/0151313 A1 6/2014 Breslow et al.
2014/0299559 A1 10/2014 Bird et al.
2014/0305891 A1 10/2014 Vogler et al.
2014/0319088 A1 10/2014 Neumann et al.
2014/0326691 A1 11/2014 Hardy
2014/0360953 A1 12/2014 Pichel
2015/0034576 A1 2/2015 Wong
2015/0076089 A1 3/2015 Howard
2015/0090675 A1 4/2015 Vosshernrich
2015/0108074 A1 4/2015 Pichel
2015/0157141 A1* 6/2015 Neumann ..... A47F 5/0037 211/59.2
2015/0208830 A1 7/2015 Hardy
2015/0257547 A1 9/2015 Nagel

(56) References Cited

U.S. PATENT DOCUMENTS

| | | | |
|---|---|---|---|
| 2015/0320237 | A1 | 11/2015 | Hardy et al. |
| 2017/0007040 | A1 | 1/2017 | Howard et al. |
| 2017/0020302 | A1 | 1/2017 | Goehring |
| 2017/0196355 | A1 | 7/2017 | Hardy et al. |
| 2017/0318985 | A1 | 11/2017 | Collette |
| 2018/0103773 | A1 | 4/2018 | Chenoweth et al. |
| 2018/0360235 | A1 | 12/2018 | Hardy |
| 2020/0037785 | A1 | 2/2020 | Hardy |
| 2021/0307541 | A1* | 10/2021 | Hardy ..... A47F 7/0007 |

FOREIGN PATENT DOCUMENTS

| | | | |
|---|---|---|---|
| BE | 906083 | A2 | 4/1987 |
| BE | 1013877 | A6 | 11/2002 |
| CH | 394537 | A | 6/1965 |
| CH | 412251 | A | 4/1966 |
| CN | 2642158 | Y | 9/2004 |
| CN | 101472509 | A | 7/2009 |
| CN | 105682514 | A | 6/2016 |
| DE | 969003 | C | 4/1958 |
| DE | 1819158 | U | 10/1960 |
| DE | 2002720 | A1 | 7/1971 |
| DE | 7311113 | U | 8/1973 |
| DE | 2232398 | A1 | 1/1974 |
| DE | 2825724 | A1 | 12/1979 |
| DE | 8308485 | U1 | 9/1983 |
| DE | 3211880 | A1 | 10/1983 |
| DE | 8426651 | U1 | 2/1985 |
| DE | 8520125 | U1 | 1/1986 |
| DE | 8717386.7 | | 4/1988 |
| DE | 8717386 | U1 | 4/1988 |
| DE | 3707410 | A1 | 9/1988 |
| DE | 9300431.1 | | 3/1993 |
| DE | 29618870 | U1 | 12/1996 |
| DE | 29902688 | U1 | 7/1999 |
| DE | 19808162 | A1 | 9/1999 |
| DE | 202007011927 | U1 | 11/2007 |
| DE | 202013102529 | U1 | 6/2013 |
| EP | 9004921 | A1 | 10/1979 |
| EP | 0018003 | A2 | 10/1980 |
| EP | 69003 | A1 | 1/1983 |
| EP | 0176209 | A2 | 4/1986 |
| EP | 0224107 | A2 | 6/1987 |
| EP | 270016 | A2 | 6/1988 |
| EP | 298500 | A2 | 1/1989 |
| EP | 336696 | A2 | 10/1989 |
| EP | 0337340 | A2 | 10/1989 |
| EP | 0408400 | A1 | 1/1991 |
| EP | 0454586 | A1 | 10/1991 |
| EP | 478570 | A1 | 4/1992 |
| EP | 555935 | A1 | 8/1993 |
| EP | 0568396 | A1 | 11/1993 |
| EP | 0587059 | A2 | 3/1994 |
| FR | 3031889 | A1 | 7/2016 |
| WO | 2016124760 | A1 | 8/2016 |
| WO | 2017/024295 | A1 | 2/2017 |

OTHER PUBLICATIONS

Aug. 27, 2018—(WO) ISR and Written Opinion—App. No. PCT/US2018/037798.

Mar. 29, 2017—(PCT) International Search Report and Written Opinion—App PCT/US2017/013494.

Sep. 25, 2015—(CA) Examiner's Report—App 2847521.

Feb. 9, 2016—(AU) Office Action—App. 2014228865.

Apr. 19, 2016—(EP) Office Action—U.S. Appl. No. 15/172,675.

*RTC Industries, Inc.* v. *FFR Merchandising, Inc.*, Complaint, Case: 1:17-cv-03595 Document #1 Filed: May 12, 2017 p. 1 of 10 p. ID#:1.

Mar. 22, 2016—(WO) International Search Report and Written Opinion—App PCT/US2015/067494.

Jun. 9, 2020—(AU) Examination Report—App. No. 2018285708.

Oct. 19, 2020—(CN) First Office Action—App. No. 201880051552.1.

Jan. 19, 2021—(AU) Examination Report—App. No. 2018285708.

May 10, 2021—(EP) EESR—App. No. 21152883.1.

Apr. 28, 2021—(KR) Office Action—App. No. 10/2020/7001111.

Nov. 4, 2021—(AU) Examination Report—App. No. 2020289741.

Nov. 3, 2021—(AU) Examination Report—App. No. 202028970.

Mar. 25, 2022 (KR)—Office Action—App. No. 10-2021-7029851.

Jul. 1, 2022 (AU)—Examination Report—App. No. 2021203763.

Sep. 20, 2022—(BR) Office Action—App. No. BR112019026826-0.

* cited by examiner

PRODUCT MANAGEMENT DISPLAY SYSTEM WITH TRACKLESS PUSHER MECHANISM

CROSS REFERENCE TO RELATED APPLICATION

This application is a divisional of U.S. patent application Ser. No. 16/597,064 filed Oct. 9, 2019, which is a divisional of U.S. patent application Ser. No. 16/009,644 filed on Jun. 15, 2018, which claims priority to U.S. Provisional Application No. 62/520,985 filed Jun. 16, 2017 and U.S. Provisional Application No. 62/573,468 filed on Oct. 17, 2017. All of the above referenced applications are incorporated herein by reference.

FIELD OF THE INVENTION

The exemplary embodiments of the invention relate generally to a shelf assembly for use in merchandising product and more particularly to a shelf assembly having improved mechanisms for displaying and pushing product on the shelves along with dividers that allow the product to be closely oriented across the merchandise display system.

BACKGROUND OF THE INVENTION

It is known that retail and wholesale stores, such as convenience stores, drug stores, grocery stores, discount stores, and the like, require a large amount of shelving both to store product and to display the product to consumers. In displaying product, it is desirable for the product on the shelves to be situated toward the front of the shelf so that the product is visible and accessible to consumers. In the case of coolers or refrigerators that are used to store and display such products or beverage containers such as soft drinks, energy drinks, bottled water, and other bottled or canned beverages, it is desirable for these products to also be situated toward the front of the shelf and visible and accessible to the consumers.

To accomplish this placement of product, known systems may include inclined trays or floors that through gravity will cause the product to move toward the front of the shelf. Many of these systems include floors or shelves made of a plastic material such as polypropylene that due its low coefficient of friction permit the product to easily slide along the inclined floor or surface. However, over time, these surfaces can become obstructed with debris or sticky substances that inhibit the product from properly sliding, sometimes causing several products to tip over thus blocking additional product from moving to the front of the shelf.

Other systems include the use of a pusher system to push the product toward the front of the shelf as the product at the front of the shelf is removed. The known pusher systems are typically mounted to a track and include a pusher paddle and a coiled spring to urge the product forward. Occasionally, as the system is used, and over time, the track becomes obstructed with dirt or sticky materials that hinder the proper operation of the pusher system in the track. In addition, depending on the size, shape and weight of the product to be merchandised, the known pusher paddles may occasionally tip or bend backwards, thereby causing a binding of the pusher mechanism in the track. In those situations, the pusher mechanism may not properly push product toward the front of the shelf.

One exemplary embodiment is directed at improving upon existing merchandising systems by providing a trackless pusher system that works with gravity-fed merchandise systems (i.e., inclined shelves or trays) and non-gravity-fed merchandise systems.

SUMMARY OF THE INVENTION

This disclosure generally relates to a product management display system for merchandising product on a shelf. This system may include a trackless pusher mechanism that travels along a surface on which product is placed. The trackless system overcomes the known problems with the use of tracks to hold and guide the known pusher mechanisms. It should be understood however that the teachings of this embodiment may be used with systems that include tracks for mounting a pusher mechanism or the like. The pusher mechanism may include a pusher paddle and a floor that extends forward of the pusher paddle. A flat coiled spring or other biasing element can be operatively connected behind the pusher paddle and extend across the floor of the pusher mechanism and to the front of the shelf. Alternatively, the flat coiled spring or biasing element can extend across the divider to the front of the shelf assembly. With this configuration, the pusher paddle is prevented from tipping or bending backwards during operation.

In accordance with an exemplary illustrative embodiment of the invention, the pusher paddle may define a concave pushing surface for pushing cylindrical products, such as soft drink bottles or cans, and to keep the paddle centered on the track and behind the product. Alternatively, the pusher paddle may define a flat pushing surface that may further include at its upper edge a curved rib or similar structure that can also be used to push cylindrical products.

In accordance with another exemplary illustrative embodiment of the invention, the floor of the pusher mechanism can include a notched or cut-out portion to align the pusher mechanism relative to the coiled spring. Also, the floor of the system also can include a notch or cut-out portion for receiving and mounting a flat end of the coiled spring to the floor. A spring tip may be placed on the end of the coiled spring to mount the coiled spring to the floor of the system. Alternatively, the end of the coiled spring can mount to the divider of the assembly.

In accordance with another exemplary illustrative embodiment, this disclosure may relate to a product management display system comprising: a tray having a floor for supporting product having a front end and a rear end, a plurality of forward support posts extending from the floor at the front end of the tray and a plurality of rear support posts extending from the floor at the rear end of the tray. The system may further include a plurality of dividers connected to the tray, where each divider of the plurality of dividers has a first end, a second end, a wall extending between the first end and the second end, and a bottom surface of the wall spaced from the floor of the tray creating an opening between the floor and the bottom surface. Each divider of the plurality of dividers may separate the tray into a plurality of product dispensing rows. A pusher mechanism may be configured to move product toward the front end of the tray within each product dispensing row. Each divider may further comprise a support column extending from the bottom surface at a first end and is secured to the tray at a second end. The floor may have a plurality of elongated pockets positioned along the floor such that at least one of the plurality of elongated pockets is aligned with at least one groove positioned within one of the plurality of forward support posts and at least one groove positioned within one of the plurality of rear support posts. The support column of at least one divider of the plurality of dividers may be secured within one of the plurality of elongated pockets. Each divider may also have an engaging member at a first end that attaches to one of the plurality of forward support posts and an engaging member at a second end that attaches to one of the plurality of rear support posts, where the engaging member may be a hook-like member feature. The plurality of dividers may also comprise two configurations of dividers, wherein a divider of a first configuration of dividers has a support column located closer to the first end, and a divider of the second configuration of dividers has a support column located closer to the second end. A divider of the first configuration of dividers may be adjacent to a divider of the second configuration of dividers when installed in the tray, where the plurality of dividers are arranged in an alternating pattern using dividers of the first configuration of dividers and dividers of the second configuration of dividers. The product may be a plurality of beverage containers. Additionally, the product dispensing rows may be configured such that a first product positioned in a first row contacts a second product positioned in an adjacent row through the opening between the bottom surface of one of the plurality of dividers and the floor of the tray.

Still other aspects of this disclosure may relate to a product management display system comprising: a tray having a front end, a rear end, and a floor configured to support product. The system may also include a plurality of forward support posts extending from the floor at the front end of the tray and a plurality of rear support posts extending from the floor at the rear end of the tray. The system may include a plurality of dividers connected to the tray, where each divider of the plurality of dividers has a first end, a second end, and a wall extending between the first end and the second end. The wall may have a bottom surface spaced from the floor of the tray that creates an opening between the floor and the bottom surface. The plurality of dividers may separate the tray into a plurality of product dispensing rows. The system may also comprise a pusher mechanism configured to move product toward the front end of the tray within each product dispensing row, where each product dispensing row is configured such that a first product positioned in a first row of product dispensing rows contacts a second product positioned in an adjacent row through the opening between the bottom surface of one of the dividers and the floor of the tray. The floor of the tray may have a plurality of elongated pockets positioned along the floor such that at least one of the plurality of elongated pockets is aligned with at least one groove positioned within the forward support post. The plurality of dividers may also comprise two configurations of dividers, where a divider of a first configuration of dividers has a support column located closer to the first end of the divider and a divider of the second configuration of dividers has a support column located closer to the second end of the divider. A front to rear distance between the support column of a first divider of the first configuration of dividers to the support column of a first divider of the second configuration of dividers is equal to or greater than to a distance of two diameters of the product. As another feature, the plurality of product dispensing rows may comprise at least five rows.

Yet another aspect of this disclosure may relate to a product management display system comprising: a tray having a front end, a rear end, and a floor configured to support a plurality of product, wherein the floor includes a plurality of grooves such that each groove of the plurality of grooves engages one of a plurality of divider walls, wherein each divider wall separates the tray into a plurality of product dispensing rows. The system further includes a pusher mechanism configured to move product toward the front end of the tray within each product dispensing row of the plurality of product dispensing rows, where each divider wall may be arranged to laterally shift within each groove as the product is moved forward by the pusher mechanism to allow the product and the product dispensing rows to be positioned closely together. A plurality of forward support posts may be positioned at the front end of the tray and a plurality of rear support posts are positioned at a rear end of the tray, where each groove of the plurality of grooves may extend vertically along the forward and rear support posts. Each divider wall of the plurality of divider walls may also include a first engaging member at the first end of the divider that engages with a corresponding engaging member of the forward support post and a second engaging member at a second end of the divider wall that engages with a corresponding engaging member of the rear support post such that the divider wall is placed in tension when secured using the engaging members of the divider wall. In addition, a product retaining member may extend from one of the plurality of forward support posts to an adjacent forward support post. In addition, the divider walls may be made from a transparent material, and each groove may have a width that is larger than a thickness of each divider wall to allow each divider wall to shift laterally within the groove as product is moved forward by the pusher mechanism.

Figure 1:
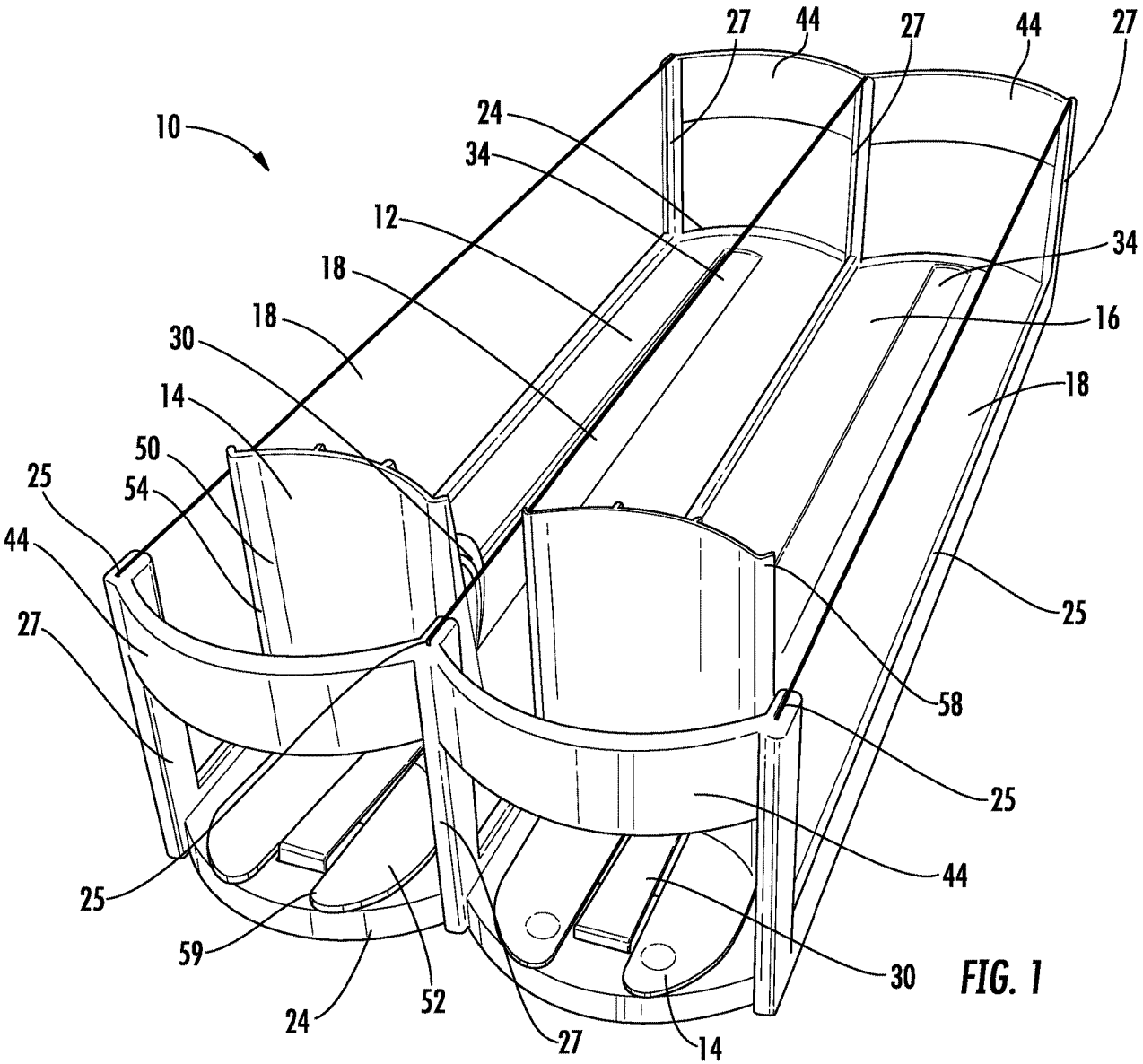
FIG. 1 illustrates an isometric view of an exemplary embodiment of a product management display system as disclosed herein.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, the use of the term "mount," "mounted" or "mounting" is meant to broadly include any technique or method of mounting, attaching, joining or coupling one part to another, whether directly or indirectly.

DETAILED DESCRIPTION OF THE EMBODIMENTS

The invention may be embodied in various forms. Referring to the Figures wherein like numerals indicate like elements, there is depicted in FIG. 1 an isometric view of an exemplary embodiment. Exemplary merchandise system 10 includes a product dispensing tray 12 with multiple product dispensing rows in which each product dispensing row has mounted an exemplary trackless pusher mechanism 14. As described in more detail below, the pusher mechanism 14 will fit in the tray 12 and will slide along the surface of the tray without the use of tracks, rails, or guides typically used to hold a conventional pusher mechanism to the tray or floor of the tray. The pusher mechanism defines a pusher paddle and a pusher floor that extends forward of the pusher paddle. A coiled spring may extend across the pusher floor and operatively connect to the tray at a forward position on the tray. In one aspect of the invention, product to be merchandised may be placed in the tray in front of the pusher paddle and may sit on the pusher floor as well as the coiled spring. With this configuration, the weight of the product will prevent the pusher paddle from tipping to ensure proper pushing of the product. In addition, the problems associated with debris or sticky materials hindering the effectiveness of known pusher systems that use tracks, rails or guides have been eliminated. Other aspects, embodiments and features of the invention and its teachings are set forth in more detail below.

The use of pusher mechanisms in product management display systems is well known. As such, the following applications describing various pusher mechanisms are incorporated by reference in their entirety, U.S. application Ser. Nos. 13/542,419, 12/639,656, 12/357,860, 11/760,196, and 11/411,761 filed Apr. 25, 2006.

The exemplary tray 12 may define a surface or floor 16 and may further comprise one or more dividing panels or dividers 18 to separate the tray 12 into numerous rows for placement of product. The surface 16 may be a solid surface or a surface defining a plurality of spaced-apart apertures to permit the slidable movement of product placed on this surface and also permits liquids and dirt to pass through the apertures so that they do not collect on the surface 16. The surface 16 may be made of any suitable material that permits the slidable movement of product on the surface 16. Other surface or floor configurations are known and may be used with the principles of the invention.

The tray 12 may have a plurality of grooves 25 positioned along the surface 16 that separate the tray 12 into numerous rows for placement of product, where the plurality of dividers 18 may be secured in the grooves 25. As an alternative arrangement, the tray 12 may have a plurality of ribs 23 with each rib including the groove 25 positioned along the surface 16 that separate the tray 12 into numerous rows for placement of product. The tray 12 may have a plurality of rows having a fixed width for product placement and may be configured to have any number of rows, such as 2, 3, 4, 5, 6, 7, or more rows. The grooves 25 may be equally spaced along the tray 12. Further each groove 25 may extend the length of the tray 12 and then extend vertically at each end of the tray 12 along forward and rear support posts 27 that extend vertically at each end of the tray 12 to receive each divider 18. As discussed above, the plurality of dividers 18 may be inserted into each groove 25. The dividers 18 may be removably or permanently secured within each groove 25.

Figure 2:
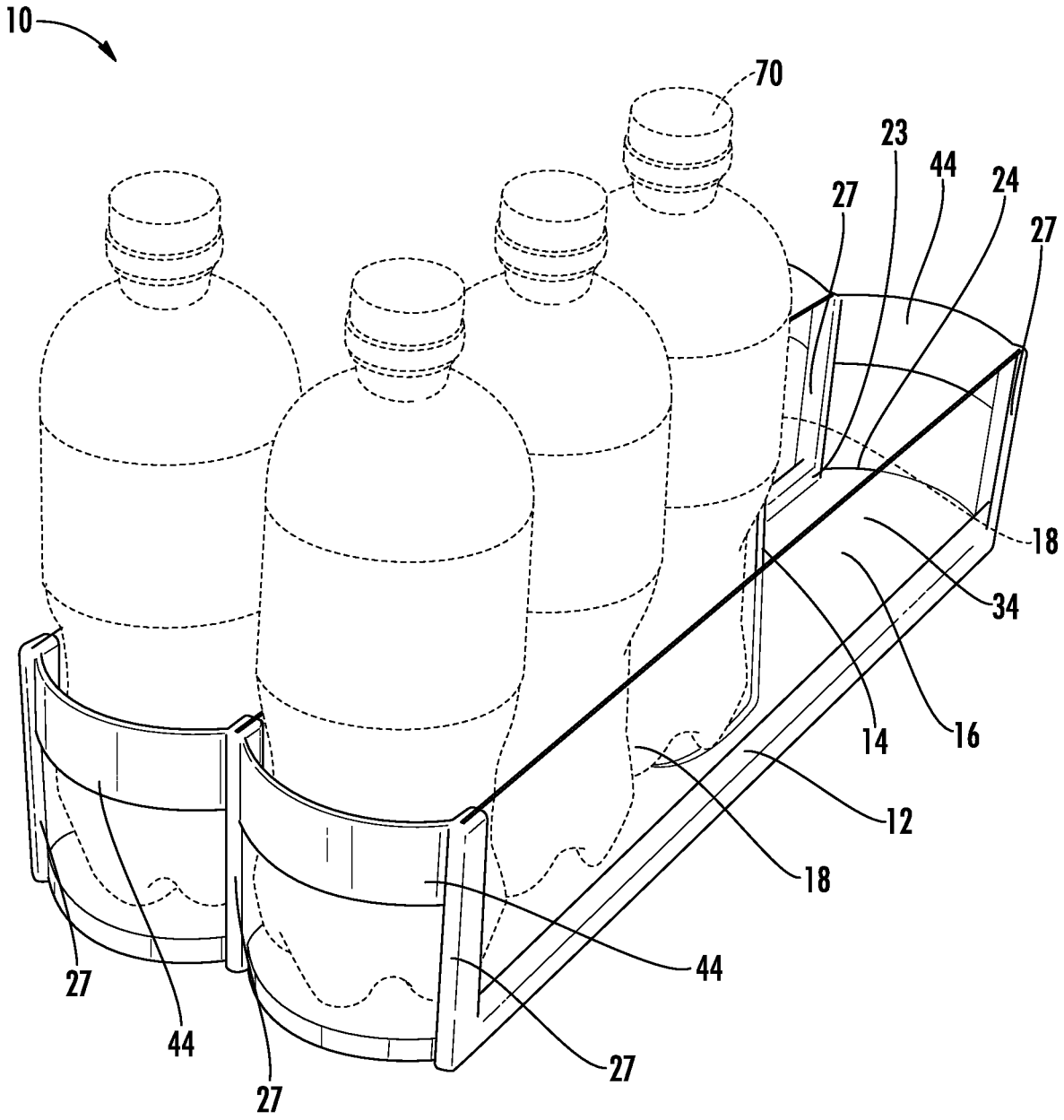
FIG. 2 illustrates another isometric view of the system of FIG. 1 with product placed in the system.
Figure 3:
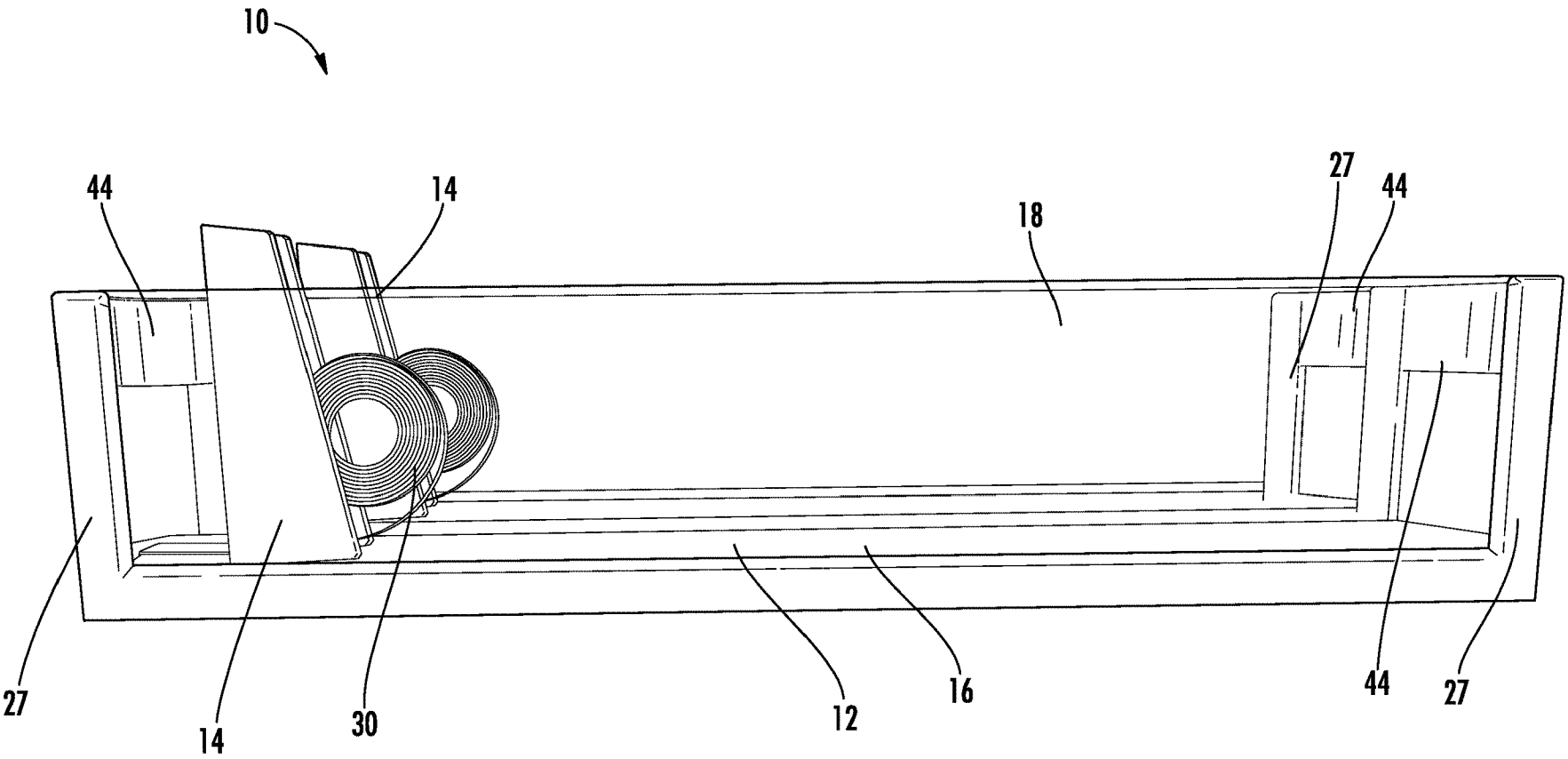
FIG. 3 illustrates a side perspective view of the system of FIG. 1.

As shown in FIG. 2, the merchandising system 10 may be configured to hold multiple rows of product together in a tight fitting manner to maximize the amount of product that can be accommodated horizontally across the tray 12. To do this, each divider 18 may be sized to take up a minimal width to allow the product 70 to have a minimal horizontal distance between the product in one row relative to the product in an adjacent row. The minimal horizontal distance may be less than 0.10 inches, or less than 0.06 inches, or even less than 0.04 inches. To accommodate the product 70 so tightly together, each divider 18 may be in contact with the product 70 positioned on either side of the divider 18. Further each divider 18 may be formed to allow the divider 18 to self-adjust by laterally shifting to accommodate the positioning and movement of the product 70 while not inhibiting the forward movement of the product when moved by the pusher 14. For example, as the product 70 is moved forward by the pusher 14, the product 70 may rock or move slightly side to side as it moves forward, the shifting or movement of the divider wall 18 allows the product 70 to stay within its designated row and keep moving forward. Even though the product 70 may contact the divider 18 or have a minimal amount of clearance between the divider 18 and the product 70, the divider's ability to shift keeps the product 70 from binding or getting stuck between the dividers 18, which is possible if the dividers 18 have a rigid construction.

Figure 9A:
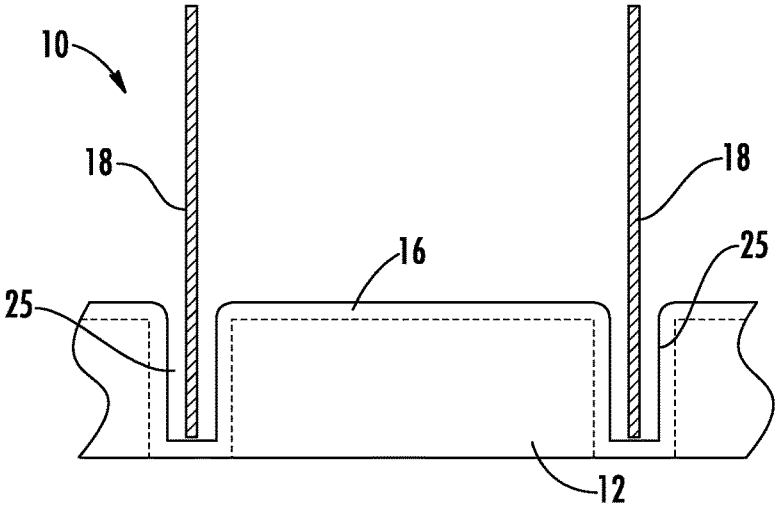
FIGS. 9A-9C illustrate simplified views of the system with some components removed for clarity.
Figure 9B:
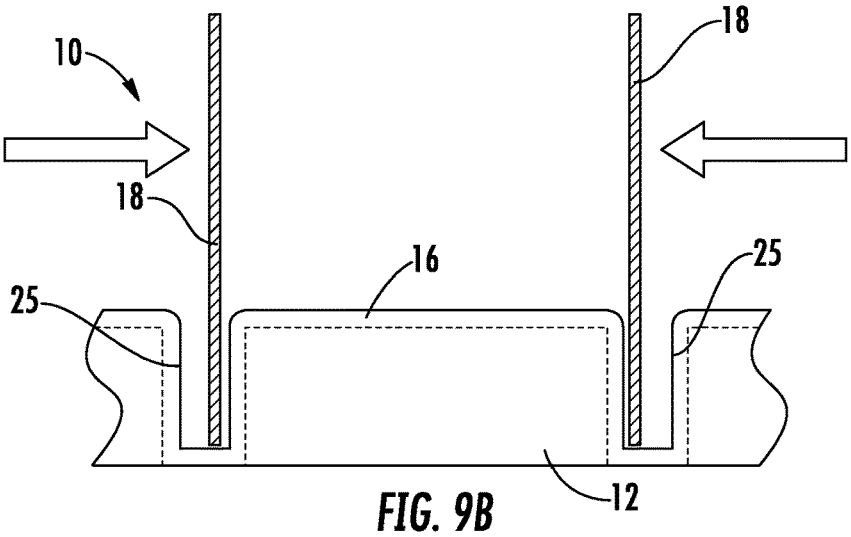
Figure 9C:
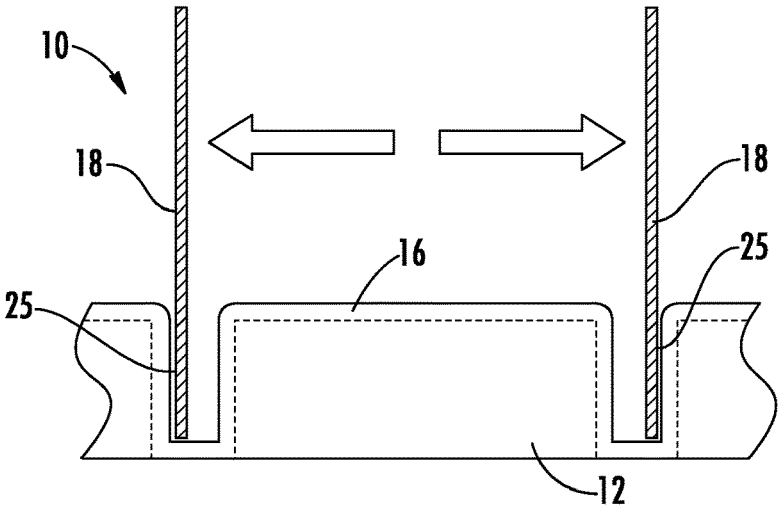
Figure 10A:
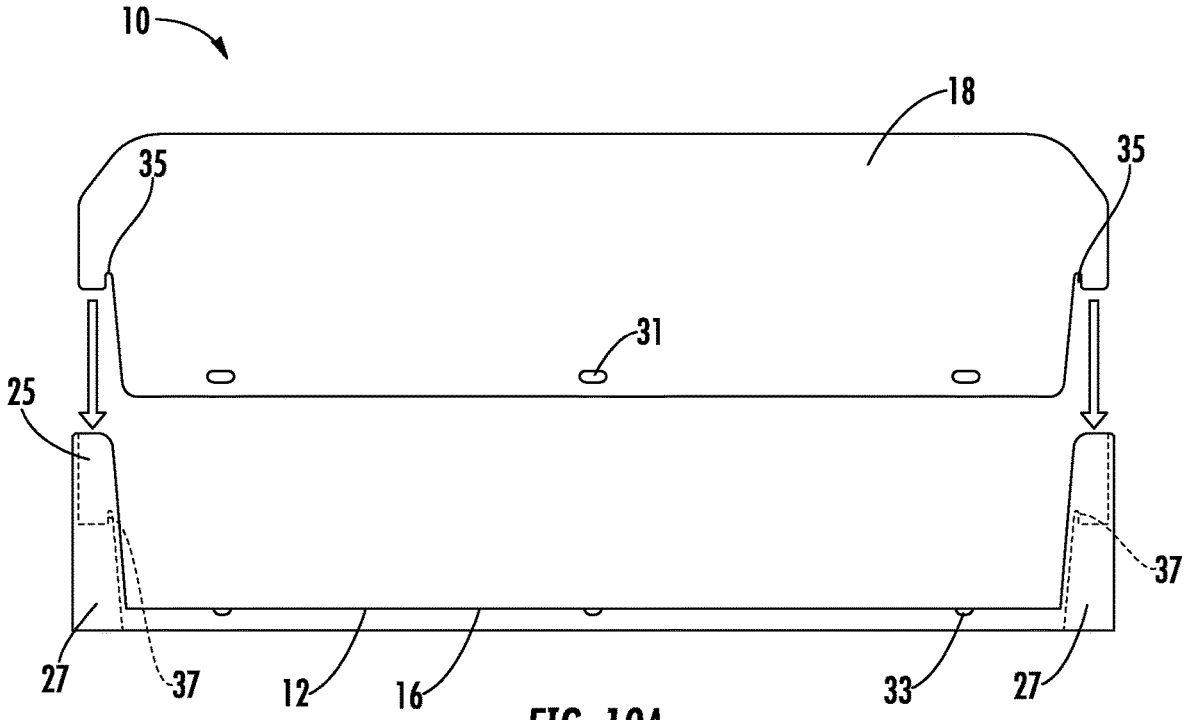
FIG. 10A illustrates a partially assembled side view of an alternate embodiment of the system of FIG. 1.
Figure 10B:
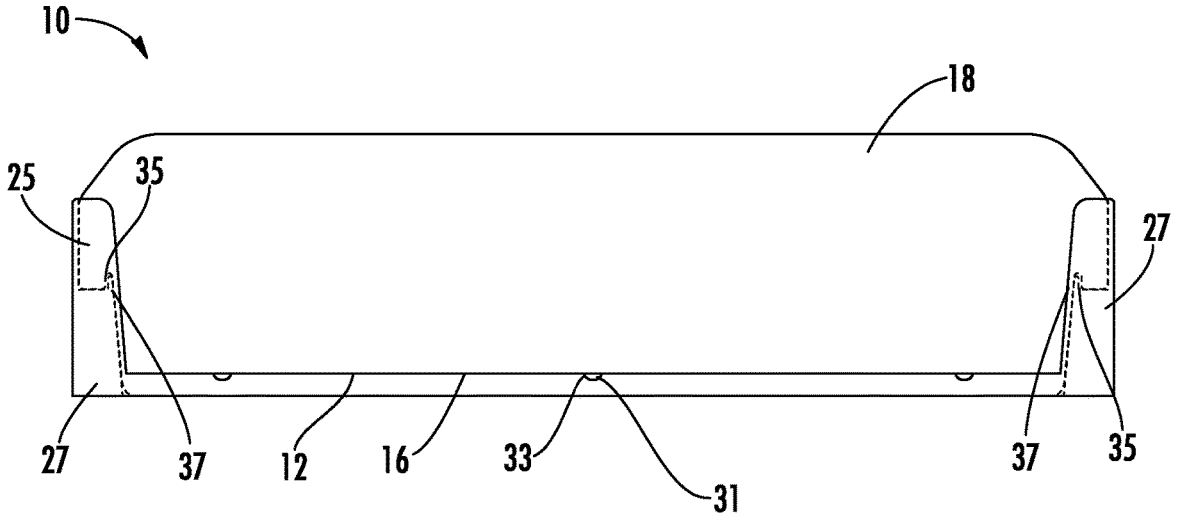
FIG. 10B illustrates a side view of the alternate embodiment of the system shown in FIG. 10A with some components removed for clarity.

As shown in FIGS. 9A-9C, each groove 25 may be sized to be larger than the thickness of the divider 18 to also allow each divider 18 to move slightly or laterally shift within each groove 25. The groove 25 may have a width that is slightly larger than the thickness of the divider 18 to both align and secure the divider 18 within the merchandising system 10. FIGS. 9A-9C are not necessarily drawn to scale but are illustrated to show the ability of the dividers 18 to shift within the grooves 25. FIG. 9A illustrates the dividers 18 positioned within the groove 25. FIGS. 9B and 9C illustrate the dividers ability to shift to the inside or outside of the groove to self-adjust the size of the product dispensing rows depending on the size of the product 70. As shown in FIGS. 10A and 10B, each divider 18 may have a plurality of apertures 31 along the bottom edge, which may engage a plurality of securing members 33 that are positioned within each groove 25 along the surface 16. Each securing member 33 may extend into a corresponding aperture 31 on the divider 18 to secure the divider 18 to the tray 12. As another option, each groove 25 may additionally have a plurality of protrusions or bumps (not shown) positioned on either one side or both sides of the groove 25 to position and align each divider 18 within each groove 25. These bumps may allow the grooves 25 to be formed with a substantially larger width than the thickness of the divider 18. The bumps may extend from either one side or both sides of the grooves 25 to allow the grooves 25 to engage the much thinner dividers 18 even though the grooves 25 may be substantially wider than the thickness of the dividers 18. Lastly, each divider 18 may have a thickness of approximately 0.030 inches or within a range of 0.015 inches to 0.060 inches, or within a range of 0.010 inches to 0.060 inches. The dividers 18 may be made of a transparent material such as a polycarbonate, or alternatively may be made of an opaque material.

As shown in FIGS. 10A and 10B, the divider 18 may also have an engaging member 35 at each end that may engage a corresponding engaging member 37 located within the groove 25 of each of the forward and rear support posts 27. The engaging member 35 may be a hook-like member that fits over the corresponding engaging member 37 in each of the forward and rear support posts 27 to further secure the divider 18 to the tray 12 in a horizontal orientation. By securing the divider 18 in a horizontal direction in this manner, the divider 18 may be placed in tension to provide further support to each divider 18 and also help to strengthen the forward and rear support posts 27 along with the product retaining members 44.

Figure 6:
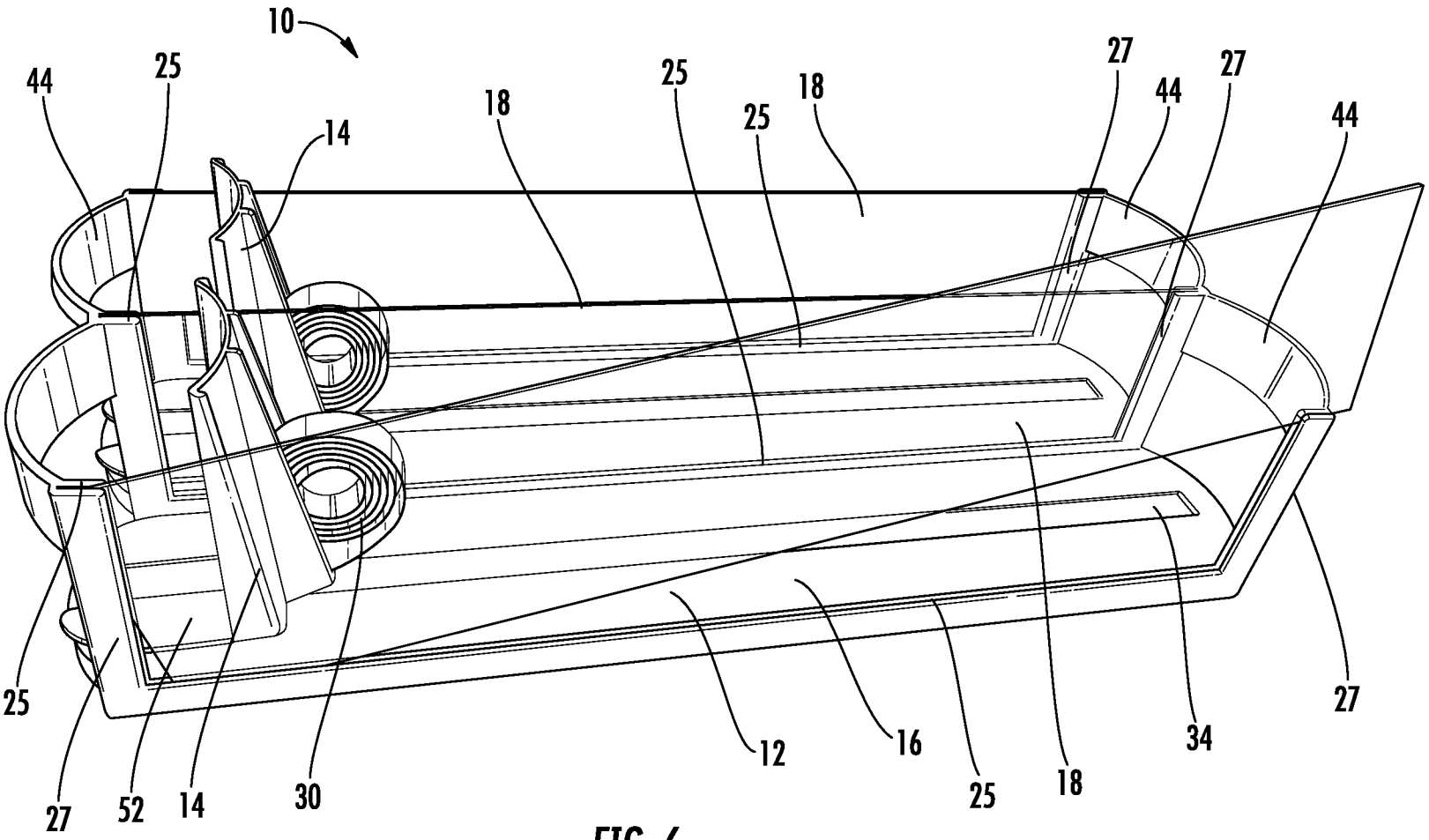
FIG. 6 illustrates a top front perspective view of a partially assembled product management display of the exemplary embodiment of FIG. 1.
Figure 7:
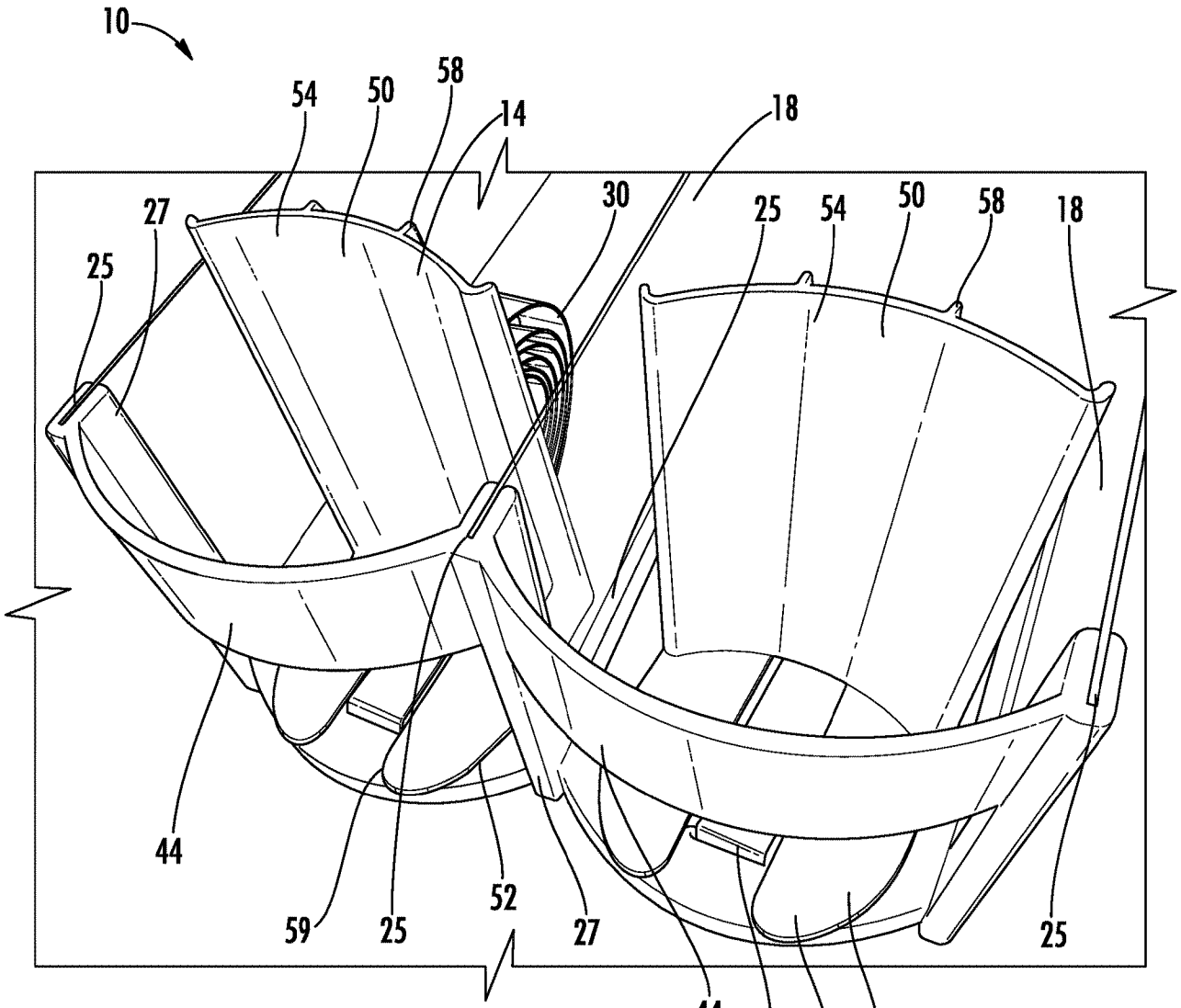
FIG. 7 illustrates an enlarged partial top front perspective view of the system of FIG. 1.

FIG. 6 illustrates a partially assembled exemplary merchandising system 10 with a divider 18 tilted to show it aligned with the groove 25 along the surface 16 and the support members 27.

As discussed above, the dividers 18 may also be used to separate product into product dispensing rows to allow the product to be loaded all the way to the rear of the tray 12 while keeping the product within the allotted row. The dividers 18 may extend substantially upwardly from each surface 16 and as illustrated in FIG. 1, may be positioned on opposing sides of the allotted rows. As discussed above, the dividers 18 may be formed separately and be detachable to provide added flexibility with the system. The dividers 18 may define numerous configurations and may extend upwardly any desired distance to provide the desired height of the dividers between the rows of product to be merchandised. Further, the dividers 18 when installed may have a height that has a portion that is substantially equal to the height of the forward or rear support posts 27. Alternatively, the dividers may have a height when installed that is greater than the height of the forward and rear support posts 27, as shown in FIGS. 10A and 10B. Alternatively, the height of the dividers 18 may be less than the height of the forward and rear support posts 27. This height also be adjustable by adding divider extenders or changing out the dividers. The height of the dividers 18 may be arranged to be above the center of gravity of each of the individual products 70 positioned within the rows.

Figure 4:
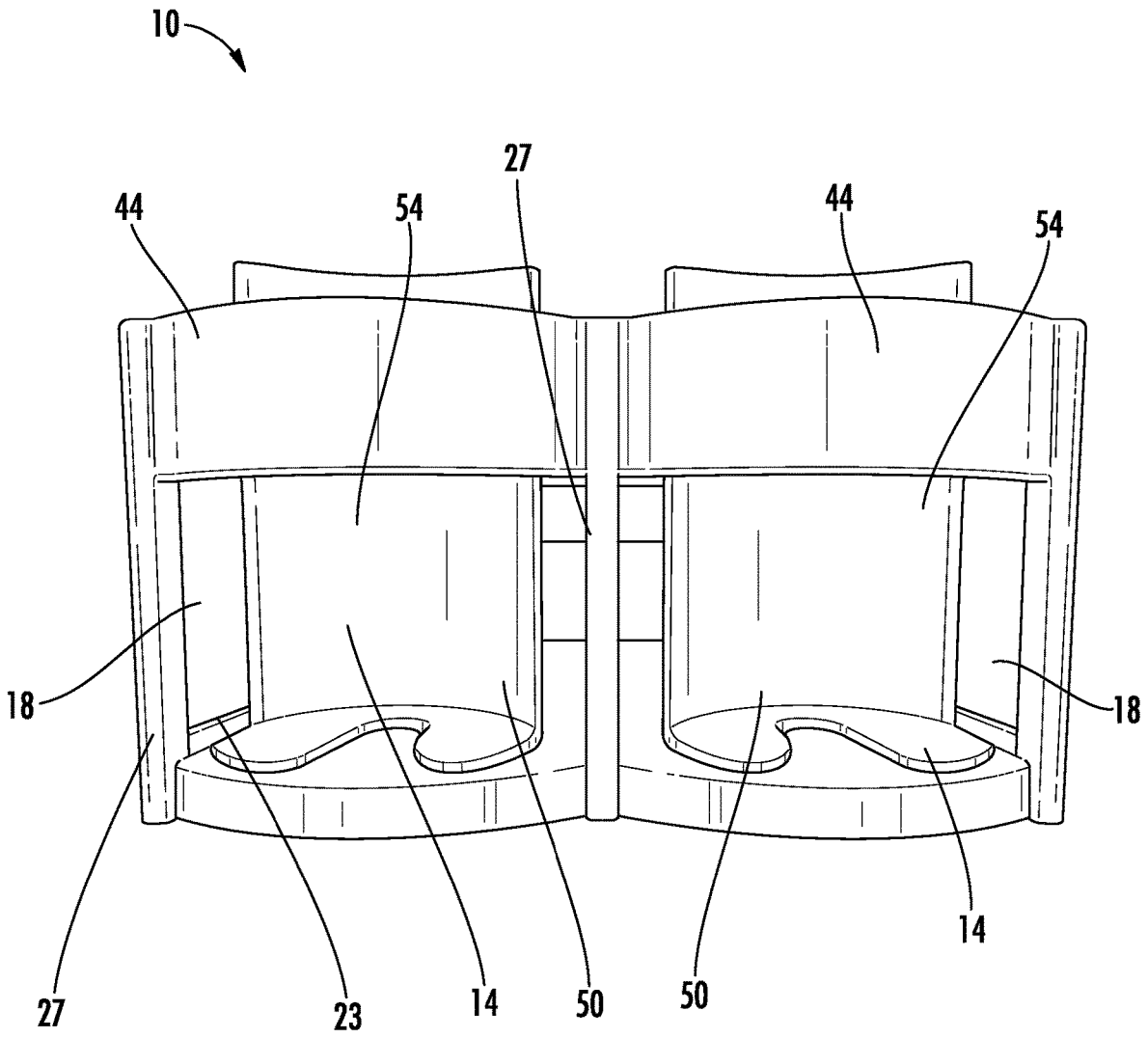
FIG. 4 illustrates a front perspective view of the system of FIG. 1.

FIG. 4 illustrates a front view of the merchandising system 10. One or more product-retaining members 44 may be located at the front of the tray 12 extending between the forward support posts 27. The product-retaining members 44 serve as a front retaining wall or bar to hold the product 70 in the tray 12 and to prevent the product from falling out of the tray 12. These members are also configured to permit the easy removal of the forward-most product 70 positioned in the tray 12. The product-retaining member 44 may be one or more curve-shaped retaining ribs as depicted in FIG. 1. These retaining members 44 may extend from one forward support post 27 to another forward support thereby joining the support posts 27 together. Additionally, a product retaining member 44 may also be positioned along the rear of the tray 12 and thus extend from one rearward support post 27 to another rearward support post 27 to join the rearward supports together. The forward product-retaining member 44 may be transparent or semi-transparent to permit visualization of the product on the shelf. One of skill in the art will readily appreciate that there are numerous shapes and configurations possible for the product-retaining member 44 and that the depicted configurations are merely exemplary embodiments of these numerous configurations.

As discussed above, the dividers 18 may be formed as a separate component, while the remainder of the product dispensing tray 12 may be formed as a unitary component. For example, both the dividers 18 along with the product dispensing tray 12 may be formed using a transparent material. Alternatively, the product dispensing tray 12 may be formed in multiple components with the forward support posts 27 along with the forward product-retaining member 44 formed separately from a transparent material and the remainder of the product dispensing tray 12 formed from an opaque material. The separately formed forward support posts 27 and forward product-retaining member 44 may then be permanently joined to the remainder of the product dispensing tray 12. As described above, the product dispensing tray 12 may have a common floor 16 with a plurality of grooves to accommodate the dividers 18. The product dispensing tray 12 may be formed a unitary member with any number of product dispensing rows. Alternatively, the product dispensing tray 12 may be formed from multiple trays 12 that may be coupled or joined together in a side-by-side manner using any known technique, including clips, dovetailing, fasteners, or the like.

Figure 5:
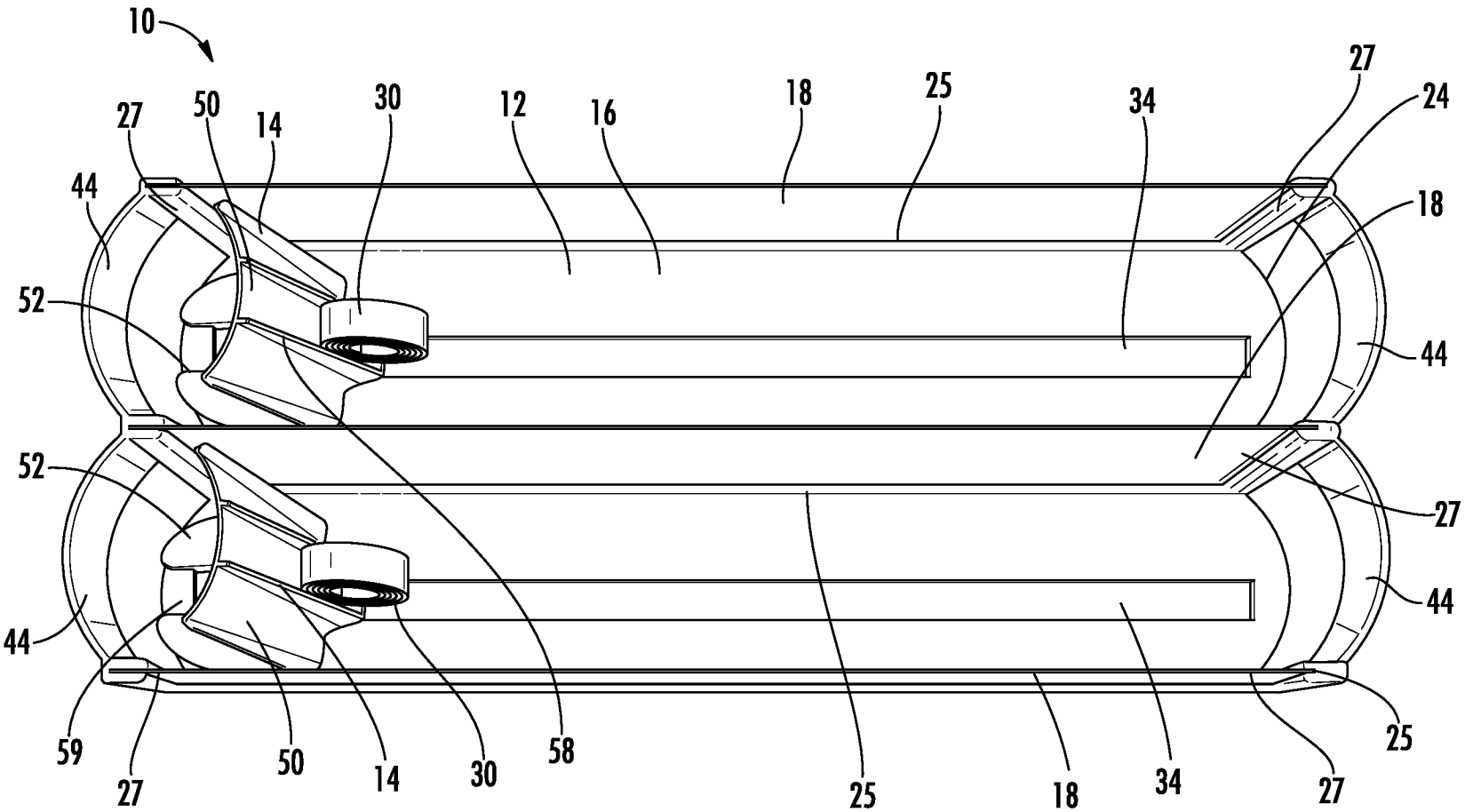
FIG. 5 illustrates a top perspective view of the system of FIG. 1.

As depicted in best in FIGS. 1 and 5, the surface or floor 16 may define a rounded end portion 24 at each end of the product rows. The end portion 24 may be rounded to match the shape of the product that is placed on the tray. For example, the depicted end portion 24 is rounded or defines a semi-circular shape to match the contour of a beverage container, such as a bottle or can that may be placed in the tray and on the end portion 24. Other shapes of the end portion may be used with the invention depending on the product to be merchandised.

Figure 11:
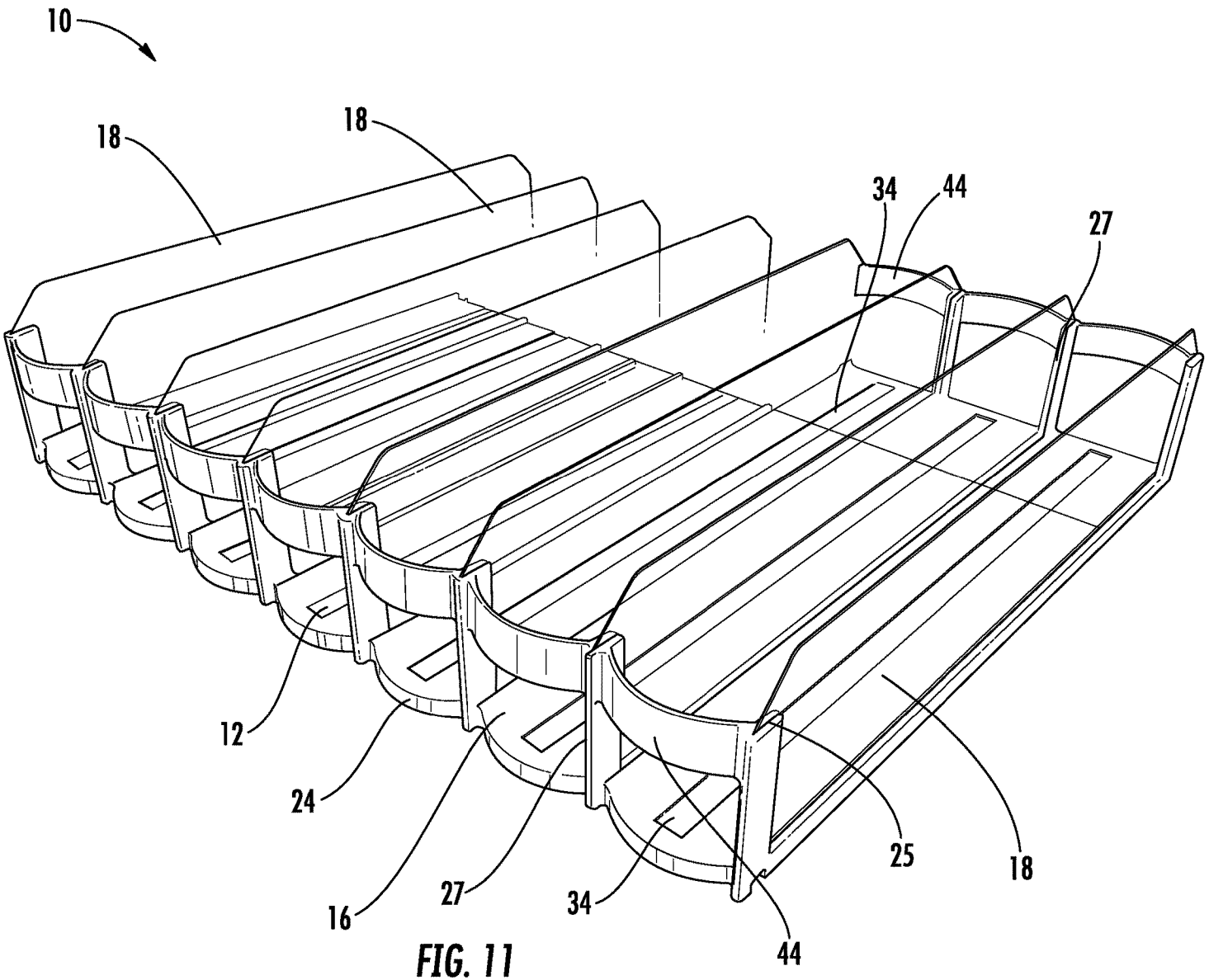
FIG. 11 illustrates an isometric view of an alternate embodiment of the product management display system with some components removed.

In addition, FIG. 11 illustrates another embodiment of the product management display system 10 with additional product dispensing rows as described above. FIG. 11 shows the tray 12 with has a portion of the surface 16 and several rear support posts 27 and rear product retaining members 44 removed. In addition, FIG. 11 has the pusher mechanisms 14 removed for clarity. As an alternative option, the product management display system 10 with the self-adjusting dividers 18 as described above may be used without a pusher mechanism 14 using a gravity-fed system where the surface 16 is angled.

Figure 12A:
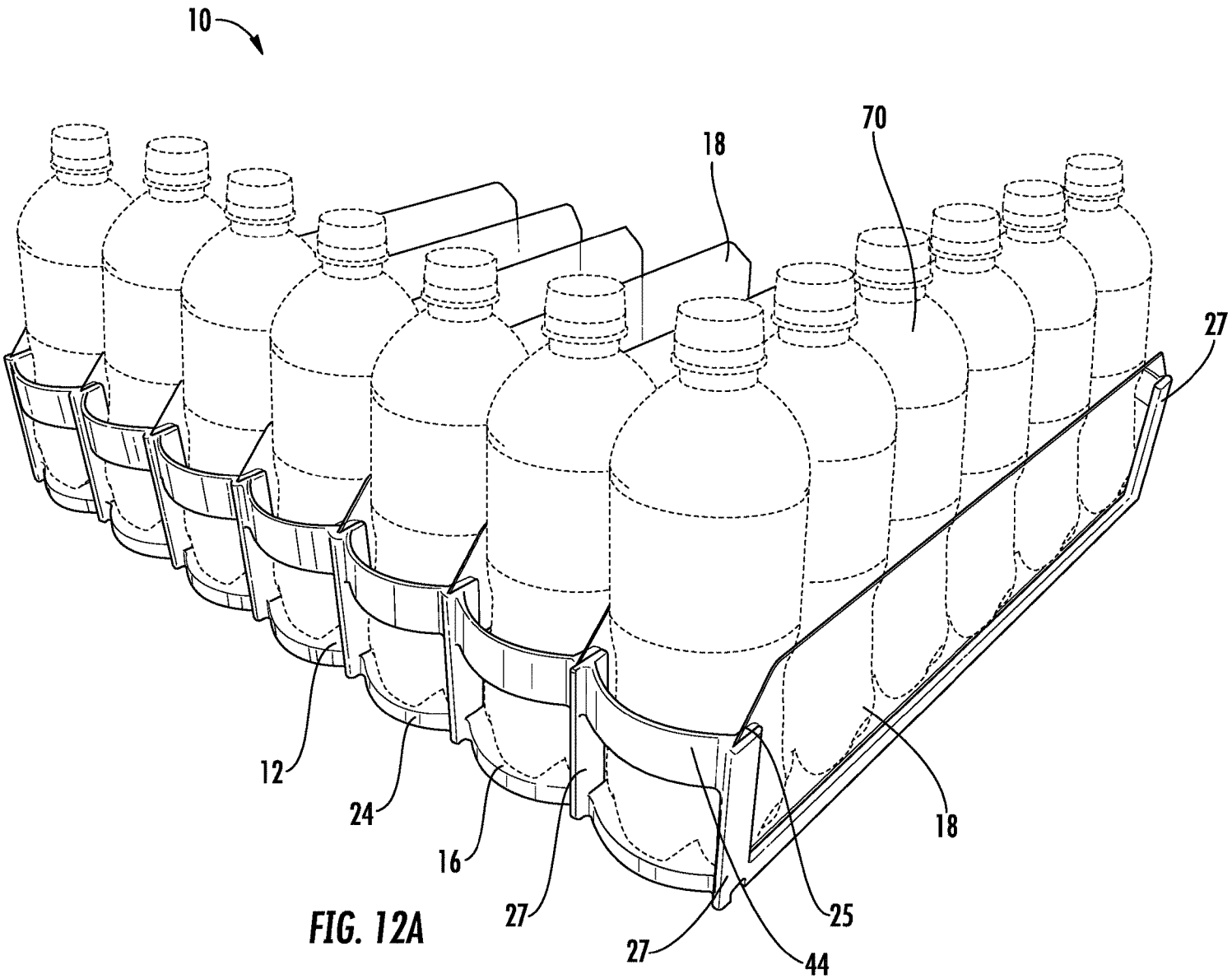
FIGS. 12A and 12B illustrate the alternate embodiment of the product management display system of FIG. 11 with product placed in the system.
Figure 12B:
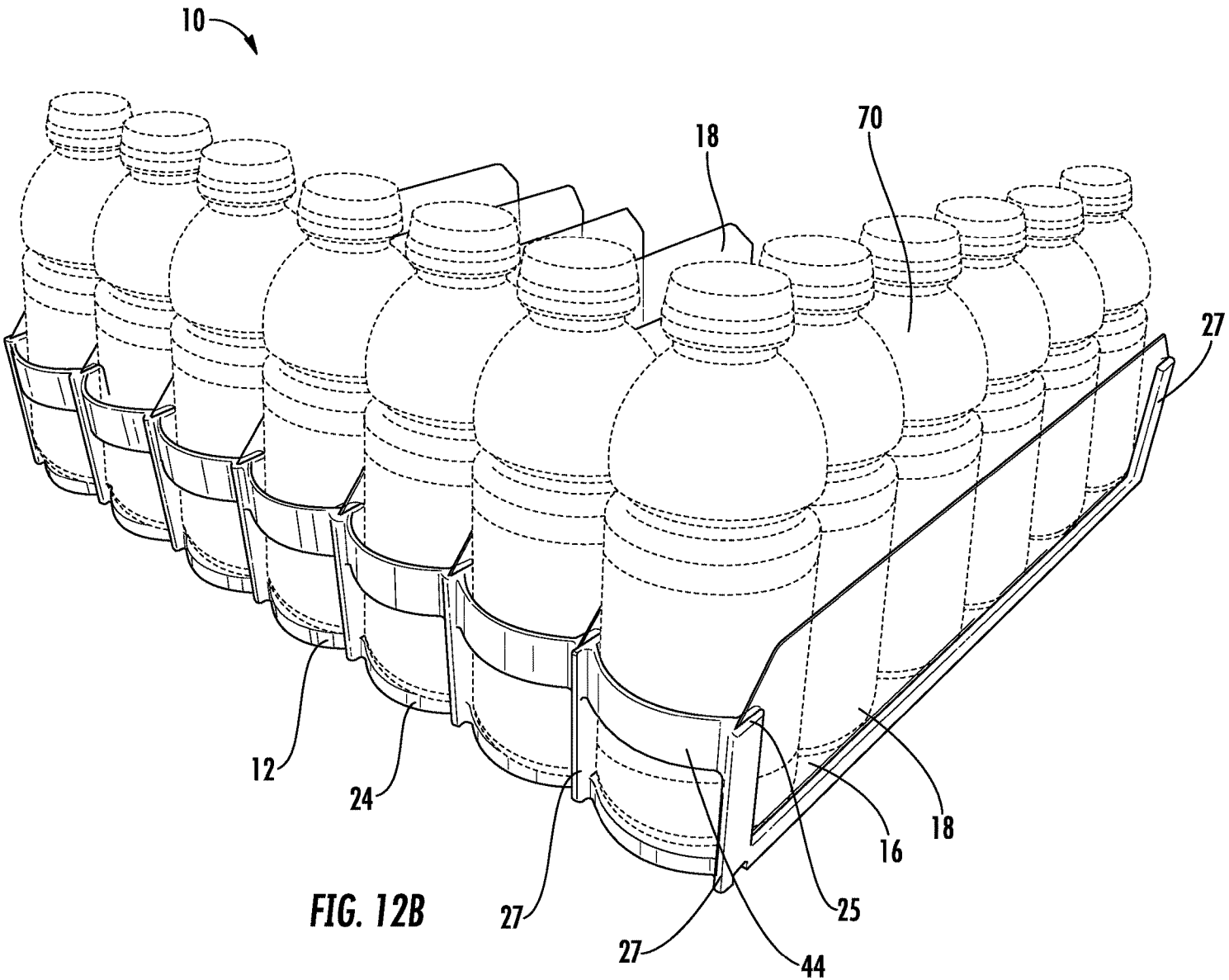

As another feature of the product management display system 10, the self-adjusting dividers may allow the tray to accommodate different size product. FIGS. 12A and 12B illustrate the product management display system 10 each having product 70 with different sizes oriented both across the tray 12 and in a front-to-rear direction. The product 70 shown in FIG. 12A may have a different size, such as a smaller or larger diameter, compared to the product 70 shown in FIG. 12B.

An aperture or notch (not shown) may be used to receive and mount an end of a coiled spring 30 or similar biasing element. A groove 34 is preferably centered across the width of the product row formed in the tray 12 and extends perpendicular to the length of the tray. This configuration will center the coiled spring 30 relative to the tray 12 and will permit the spring to extend in a substantially parallel manner relative to the length of the tray. In other words, the depicted groove 34 will permit the spring 30 to extend along the length of the tray 12 at or near the center of the product row formed by the tray. One skilled in the art will appreciate that the location and configuration of the notch may vary depending on the desired placement of the spring.

Referring back to FIG. 1, the exemplary trackless pusher mechanism 14 defines a pusher paddle 50 and a pusher floor 52. The pusher paddle 50 and pusher floor 52 may be formed as a single, unitary structure or may be separate structures that are joined together using known techniques. In addition, the pusher paddle 50 and pusher floor 52 may be made of any known suitable plastic or metal material. The pusher paddle and pusher floor may be reinforced using any known reinforcing techniques.

In one aspect, the pusher paddle 50 forms a curved-shape pusher surface or face 54 that is configured to match the shape of the product to be merchandised, such as plastic bottles or cans containing a beverage, as depicted in FIG. 2. The curve-shaped pusher surface 54 permits the pusher to remain centrally aligned with the last product in the tray. This configuration reduces friction and drag between the pusher and the divider walls. In an alternative aspect, the pusher surface or face may be a flat surface. In yet another aspect, the flat pusher surface may be accompanied by a curved shaped rib that is positioned near or on the top of the pusher paddle and that may be used to center and align product in the tray, in a manner similar to the curve-shaped pusher surface 54 depicted in FIG. 1. The curve shaped rib may define other shapes and configurations that permit cylindrical or similar shaped products to be properly pushed in the tray. Advertisement, product identification or other product information may be placed on the pusher surface 54.

Figure 8:
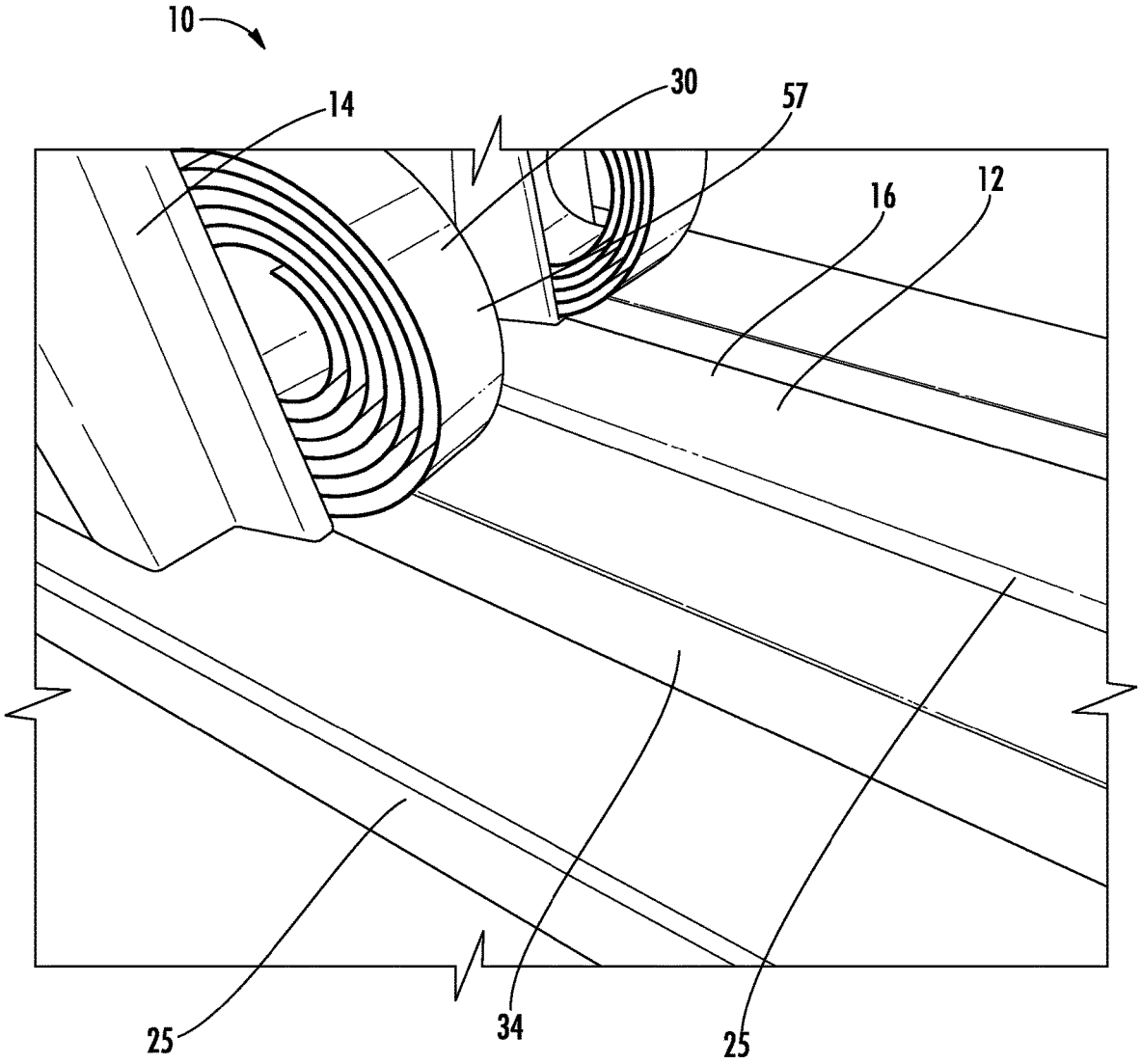
FIG. 8 illustrates an enlarged partial top rear view of the system of FIG. 1.

Positioned behind the pusher surface or face 54 may be one or more support members 58, such as ribs, walls, or gussets. The support members 58 are configured to support the pusher surface 54 and further connect the pusher paddle 50 to the pusher floor 52. As can be seen in FIG. 8, the coiled spring 30, and more specifically the coiled end 57 that is used to urge the pusher paddle 50 forward and along the tray 12, as understood in the art. Any technique used to operatively connect the coiled spring to the pusher paddle 50 may be used with the invention.

As shown in FIG. 1, the pusher floor 52 may be positioned below the pusher paddle 50 and may extend forward of the pusher surface 54 of the pusher paddle. The pusher floor 52 may extend any predetermined distance and at any predetermined angle. For example, the pusher floor 52 may extend substantially perpendicular to the pusher surface 54. In the exemplary embodiment, the pusher floor 52 may extend a sufficient distance to permit one product, such as a single bottle or can, to be placed on the pusher floor. In another aspect, the pusher floor 52 may be configured to permit more than one product to be placed on the pusher floor. The pusher floor 52 may define any shape, including the depicted round shape and may define any product retaining features on the surface of the pusher floor 52, such as ribs, walls, or the like, to further hold the product on the pusher floor 52.

As can be seen in FIG. 1, the pusher floor 52 may define an elongated channel, groove or recessed portion 59 that is sized, shaped and configured to seat the coiled spring 30. In the exemplary embodiment, the channel or groove 59 may extend across the pusher floor 52 and in a substantially perpendicular manner relative to the pusher paddle 50. In an alternative aspect, the groove or channel may extend partway or across the entire pusher floor 52. Such configuration permits the proper alignment and positioning of the pusher paddle 50 in the tray. The groove 59 may define a depth that matches or exceeds the thickness of the coiled spring 30. With this configuration, the coiled spring 30 will seat at or below the pusher floor surface such that product will not sit directly on the coiled spring, rather, such product will sit on the pusher floor surface. The pusher floor 52 may be a solid surface or may include apertures and openings through which debris or other items may pass.

As should be appreciated by those skilled in the art, there are many possible techniques that may be used with the described pusher mechanisms for facilitating the movement of the product on the shelf or floor.

The underneath side of the pusher floor 52 may be a smooth planar surface that will slide freely along the surface 16. Alternatively, and similar to above, the pusher floor 52 may include beads, runners, rollers or the like that will permit the pusher floor to slide along the surface yet raise the pusher floor up off of the surface 16. In another alternative embodiment, the underneath side of the pusher floor may be configured with rail mounting members to permit the mounting of the pusher to a track or rail, as understood in the art.

The pusher floor further defines a notch or cut-out portion through which will pass the coiled spring 30. The end 29 of the coiled spring 30 will pass through the notch and through the notch of the surface 16 and will mount to the tray using any of the techniques described above.

In use, as the pusher mechanism 14 is urged rearward in the tray 12, the end of the coiled spring 30 will be held in position as described above and the coiled end of the spring 30 will begin to uncoil behind the pusher paddle 50. If the pusher 14 is allowed to move forward in the tray 12, such as when product is removed from the front of the tray, the coiled end of the spring 30 will coil and force the pusher paddle 50 forward in the tray 12, thereby urging product toward the front of the tray.

In an alternative embodiment, the coiled spring 30 may extend below and underneath the pusher floor 52 as opposed to above and across the pusher floor, as depicted in the figures. With this configuration, the groove 59 and notch may not be necessary.

The coiled spring 30 may be any biasing element including, without limitation, a flat coil spring commonly used with pusher systems. The present invention may use one or more coiled springs to urge the pusher mechanism 14 forward depending on the desired application. The coil tension of the spring 30 may also vary depending on the particular application.

Referring to FIGS. 1, 3, 5, and 7, the trackless pusher mechanism 14 is shown mounted to the tray 12. As illustrated, the pusher mechanism 14 fits in the tray 12 between the dividers 18. The end of the coiled spring 30 may extend through the notch in the pusher floor and mounts to the tray as described above. In use, the pusher mechanism 14 will slide along the surface 16 of the tray 12 without the use of tracks, rails, or guides. As depicted in FIGS. 1, 3, 5, and 7, the pusher mechanism 14 is shown in a forward position.

Referring to FIG. 2, the pusher mechanism 14 is shown merchandising multiple products 70 in the merchandise system 10. The product is prevented from tipping out of the tray by the product-retaining member 44. The product 70 may be any product to be merchandised including the depicted soft drink bottle. As shown in FIG. 2, the product 70 sits on the pusher floor 52 and the coiled spring 30 that extends below the product. The weight of the product on the pusher floor 52 and the positioning of the product across the spring 30 prevent the paddle 50 from tipping in the tray 12. In use, as one product is removed from the front of the tray near the product-retaining member 44, the pusher mechanism 14 (through the urging of the coiled spring 30) will push the remaining product forward in the tray 12 until the forward-most product contacts the product-retaining member 44. As additional products are removed, the pusher mechanism 14 will continue to push the remaining product toward the product-retaining member 44.

As stated above, the trackless pusher mechanism 14 may be used with gravity-fed systems, that is, systems having trays or product channels that are mounted on an incline to permit gravity to assist with the merchandising of the product. Alternatively, the trackless pusher mechanism 14 may be used with systems that are mounted in a non-inclined or in a horizontal manner where gravity will provide little or no assistance with the merchandising of the product. The trackless pusher mechanism 14 may also be used to push various shaped products.

FIGS. 13-18 illustrate an alternate embodiment of product management display system 100. In this alternate embodiment of product management display system 100, some of the features labeled 1XX of the product management display system 100 may be similar to the features labeled XX of product management display system 10 described above and thus may be described in lesser detail or no detail at all. For example, the trackless pusher mechanism 114 may be similar to the other trackless pusher mechanism 14 described above.

Figure 13:
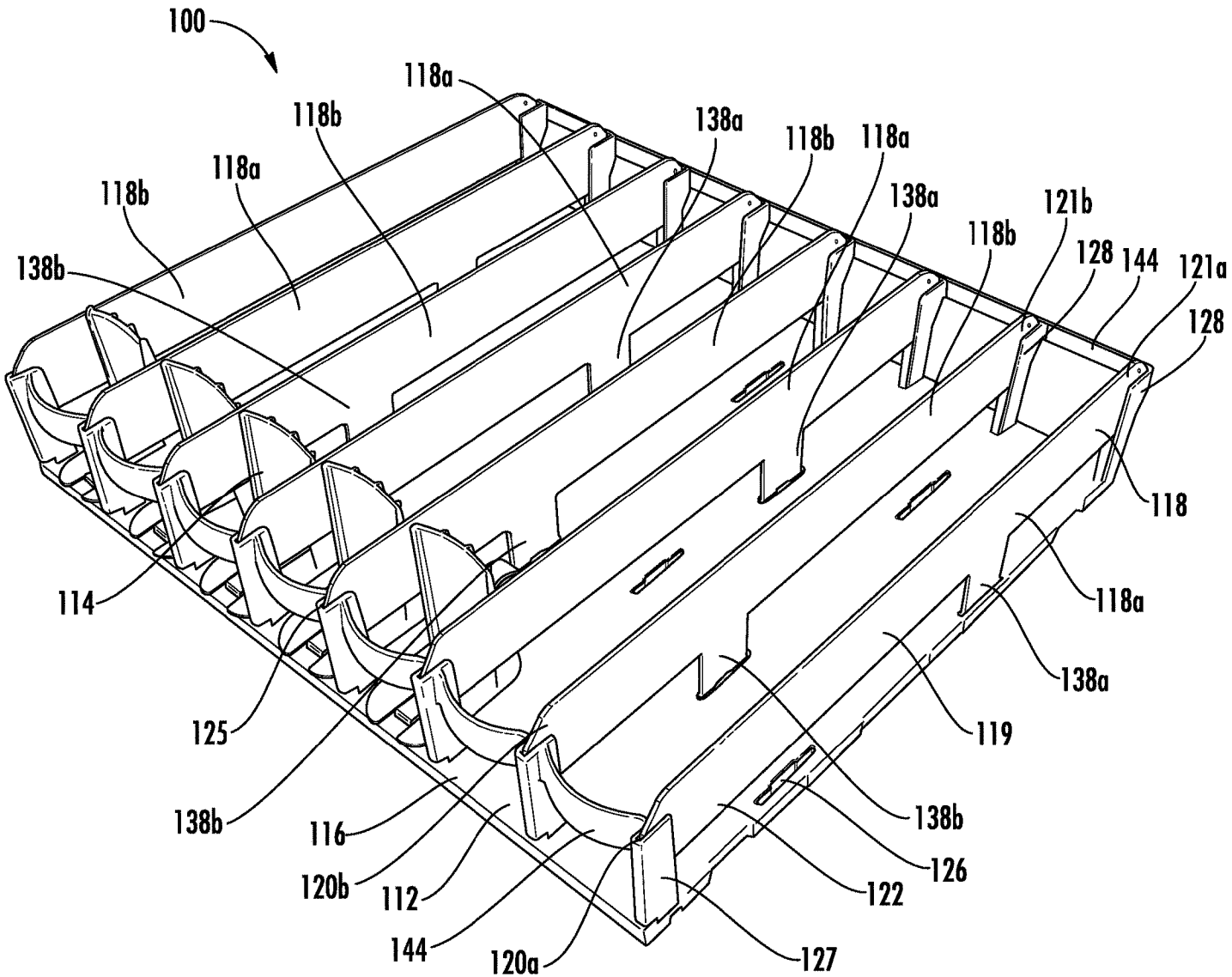
FIG. 13 illustrates an isometric view of an alternate embodiment of the product management display system with some components removed for clarity.

FIG. 13 illustrates an isometric view of the product management display system 100 with a couple of the trackless pusher mechanisms 114 removed for clarity. The system 100 may comprise a tray 112 having a floor 116 with a plurality of rows to receive multiple products 70 in each row. For example, the product 70 may comprise a plurality of bottles, such as plastic bottles or cans containing a beverage. The tray 112 may also have a plurality of vertically oriented forward support posts 127 that are joined together with product retaining members 144 positioned at the forward end of each row of the tray 112, and a plurality of vertically oriented rear support posts 128 that are joined together with product retaining members 144 positioned at the rear end of each row of the tray 112. In addition, a plurality of dividers 118 may be secured to the tray 112 to further distinguish and separate the rows along the floor 116. Each of the dividers 118 may be secured in a groove 125 that is located within the forward and rear support posts 127, 128 and the floor 116 of the tray 112. The system 100 may also comprise a plurality of trackless pusher mechanisms 114 similar to those described above 14 positioned within each row.

Figure 14:
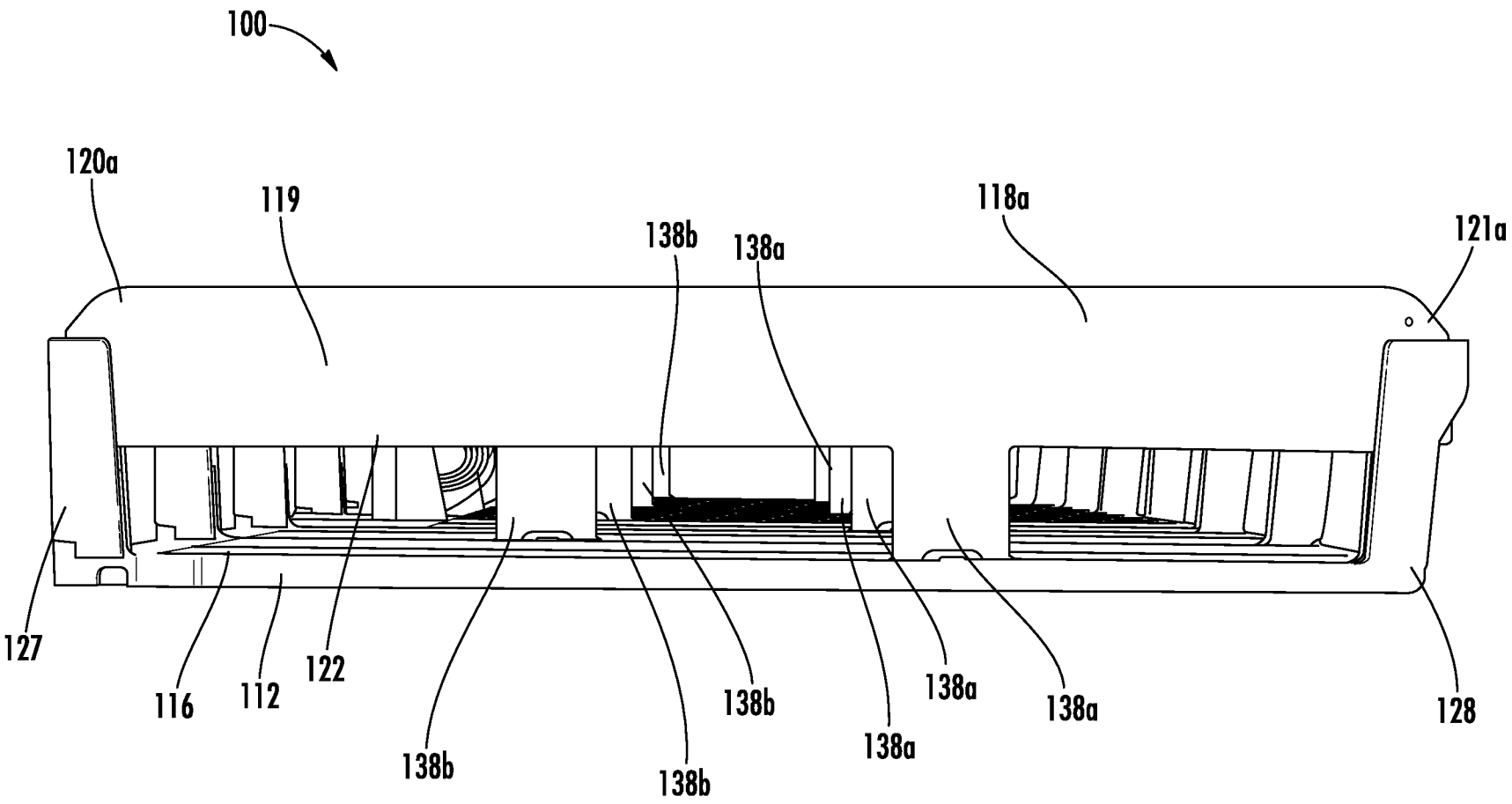
FIG. 14 illustrates a side perspective view of the alternate embodiment of the product management display system of FIG. 13.
Figure 17:
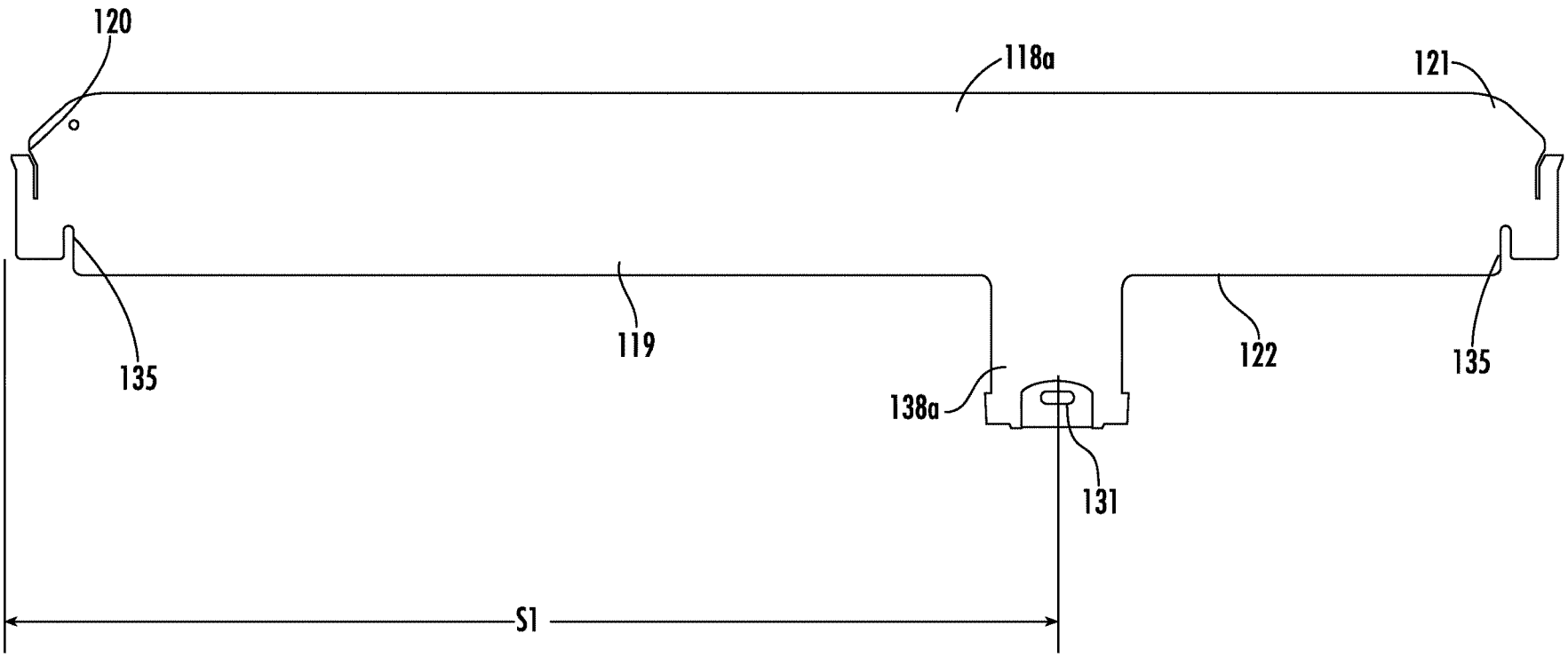
FIG. 17 illustrates a side view of a divider component of the product management display system of FIG. 13.
Figure 18:
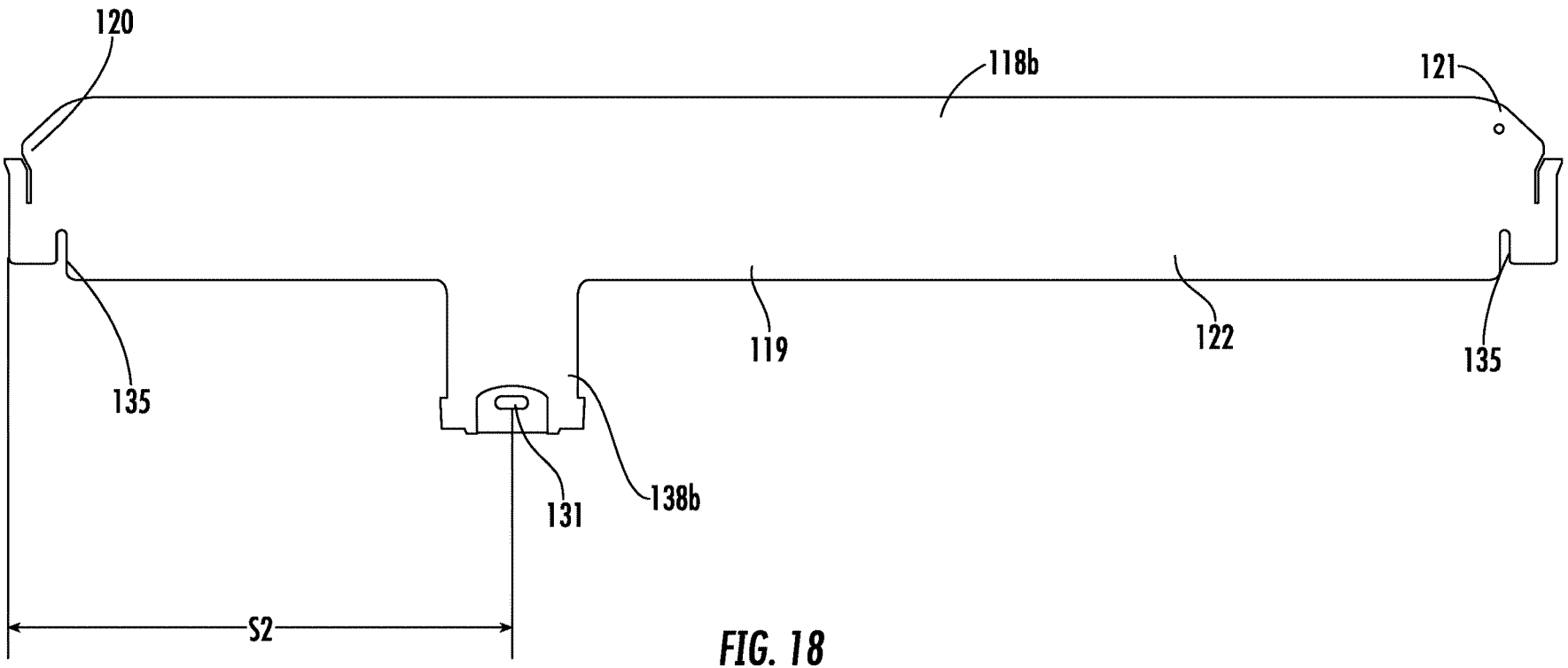
FIG. 18 illustrates a side view of a divider component of the product management display system of FIG. 13.

As shown in FIGS. 13 and 14, each of the plurality of dividers 118 may comprise a wall 119 extending continuously between first end 120 and the second end 121 of the divider 118. The wall 119 may have a top surface along with a bottom surface 122 that is spaced from the floor 116 of the tray 112. The divider 118 may also have a support column 138 that extends from the bottom surface 122 of the wall 119 and engages one of the plurality of the grooves 125 positioned within the floor 116 of the tray 112. The system 100 may have a plurality of dividers 118, which may include two divider configurations 118*a* and 118*b*. As shown in FIG. 17, divider 118*a* may have the support column 138 spaced a horizontal distance, S1, from the first end 120, where the support column 138*a* is closer to the second end 121 than the first end 120, while divider 118*b* may have the support column 138*b* spaced a horizontal distance, S2, from the first end 120, where the support column 138 is closer to the first end 120 than the second end 121 as shown in FIG. 18.

As shown in FIGS. 13-16, the plurality of dividers 118 may alternate between divider 118*a* and 118*b* such that the support columns 138 alternate being closer to the forward end of the tray 112 or closer to the rearward end of the tray 112. For example, the first divider 118*a* may be inserted into the groove 125 with the first end 120 engaged to the forward support post 127 and the second end 121 engaged to the rear support post 128. The support column 138*a* is positioned closer to the rear of the tray 112. The second divider 118*b* is installed adjacent the first divider 118*a* such that the support column 138*b* is closer to the front of the tray 112. Continuing the alternating pattern, the third divider 118*a*, which is the same divider configuration as the first divider 118*a*, may be installed adjacent the second divider 118*b*, which positions the support column 138*a* closer to the rear support post 128. The two divider configurations 118*a*, 118*b* continue to alternate throughout the system 100 such that the support columns 138 alternate being closer to the forward end of the tray 112 or closer to the rearward end of the tray 112. The plurality of dividers 118*a*, 118*b* are arranged to orient the support columns 138*a*, 138*b* in a staggered configuration across the tray 112.

As an alternative, the plurality of dividers 118 may be symmetrical with regards to the first end 120 and second end 121 along with their engaging members 135, such that the plurality of dividers 118 may be installed into the tray 112 in different orientations to produce the staggered support column configuration.

The tray 112 may have a plurality of rows having a fixed width for product placement and may be configured to have any number of rows, such as 2, 3, 4, 5, 6, 7, or more rows. The grooves 125 may be equally spaced along the floor 116 of the tray 112. Further, each groove 125 may extend the entire length of the tray 112 and then extend vertically at each end of the tray 112 along the forward and rear support posts 127, 128 that extend vertically at each end of the tray 112 to receive each of the plurality of dividers 118. As discussed above, the plurality of dividers 118 may be inserted into each groove 125. The dividers 118 may be removably or permanently secured within each groove 125.

Alternatively, the grooves 125 may only extend vertically at each end of the tray 112 along the forward and rear support posts 127, 128. In this configuration, the floor 116 may have a plurality of elongated pockets 126 positioned within the floor 116 to receive the support columns 138 of the dividers 118. At least one of the plurality of elongated pockets 126 may be located between and substantially aligned or coplanar with each of the grooves 125 that are positioned along the forward and rear support posts 127, 128. For example, each divider 118 may have the first end 120 and second end 121 inserted into the groove 125 at each of the forward and rear support posts 127, 128 respectively and the support column 138 inserted into the elongated pocket 126. As one option, the floor 116 may have two elongated pockets 126 that are substantially coplanar with the groove 125 to accept either divider configuration 118*a*, 118*b*.

Each groove 125 or elongated pocket 126 may be sized to have a close fit to cause the support column 138 to have a relatively fixed connection or the groove 125 or elongated pocket 126 may be sized to be larger than the thickness of the support column 138 to allow each support column to move slightly or laterally shift within each groove 125 or pocket 126 similar to the movement of the dividers 18 described above and shown in FIGS. 9A-9C. As shown in FIGS. 17 and 18, each support column 138 may have an at least one aperture 131 located near the bottom of the support column 138. As the support column 138 is inserted into either one of the grooves 125 positioned along the floor or one of the elongated pockets 126 along the floor (depending on the configuration of the tray 112), a securing member 133 (not shown) positioned within either one of the grooves 125 positioned along the floor 116 or one of the elongated pockets 126 along the floor may extend into the aperture 131 of the support column 138 to secure the column 138 to the tray 112. The aperture 131 may be centrally located along the width of the support column 138.

In addition to the plurality of dividers 118 helping to separate the rows of the tray 112, the plurality of dividers 118 provide the necessary support when loading the products 70, in this case a plurality of bottles, into the tray 112. In some conditions, when the products 70 are loaded into the rows of the tray 112, a divider 118 may bend or elastically deform, which may cause the product 70 to splay or not load properly. The support columns 138 provide a connection point to the floor 116 to create additional structural support and stiffness to the divider 118 to help minimize any bending or deformation to prevent splay or other associated problems when loading products 70. As another feature to provide additional structural support to each divider, an engaging member 135 may be formed as a slot or hook-like member on each end 120, 121 of the divider 118 to engage a corresponding engaging member on each front support post 127 and each rear support post 128. These engaging members 135 may help provide an additional tension force on the divider 118 to provide further support to each divider 118 to prevent any deformation during the loading process and thus, help prevent splay.

Figure 15:
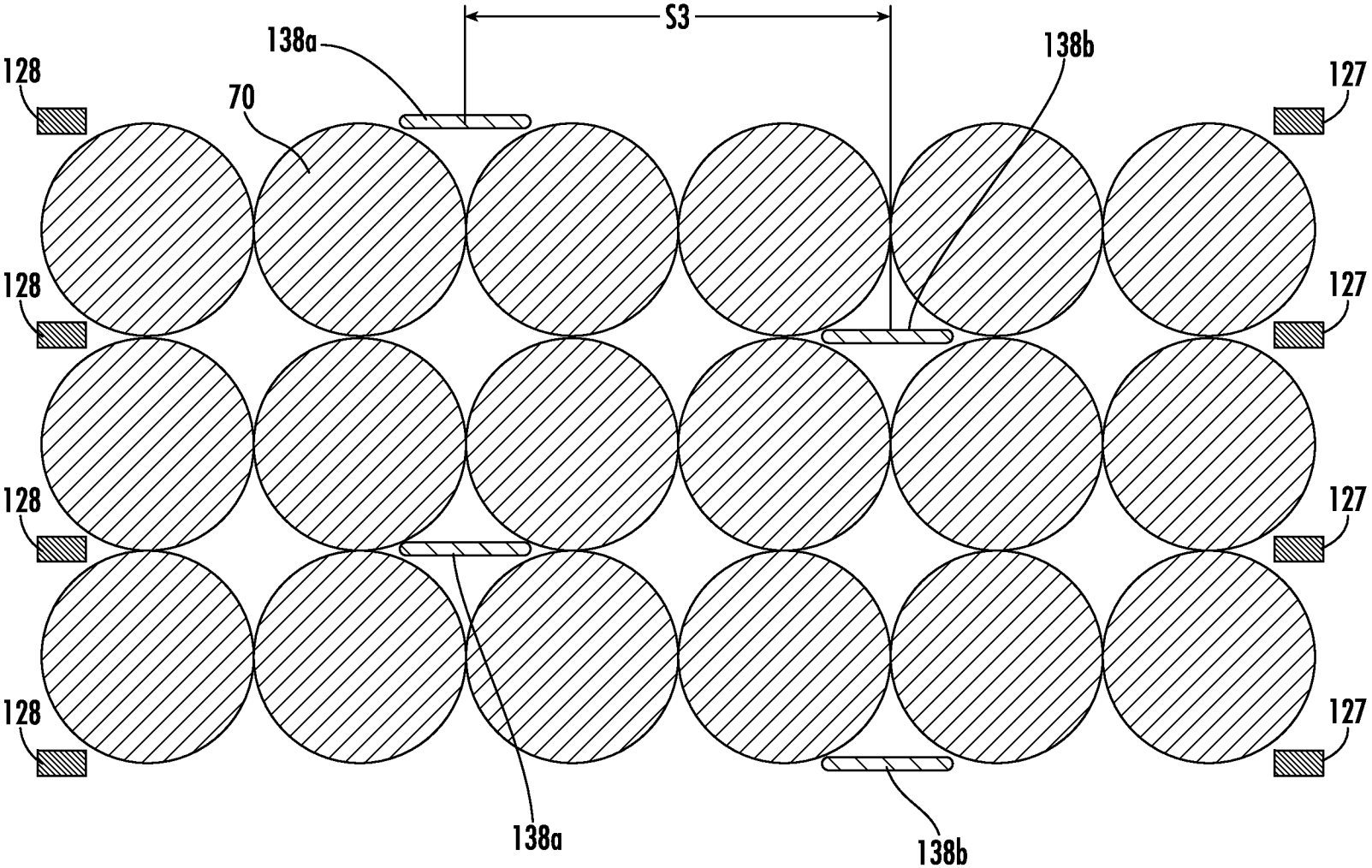
FIG. 15 illustrates a top view of a partial cross-section through the product management display system of FIG. 13 with product placed in the system.
Figure 16:
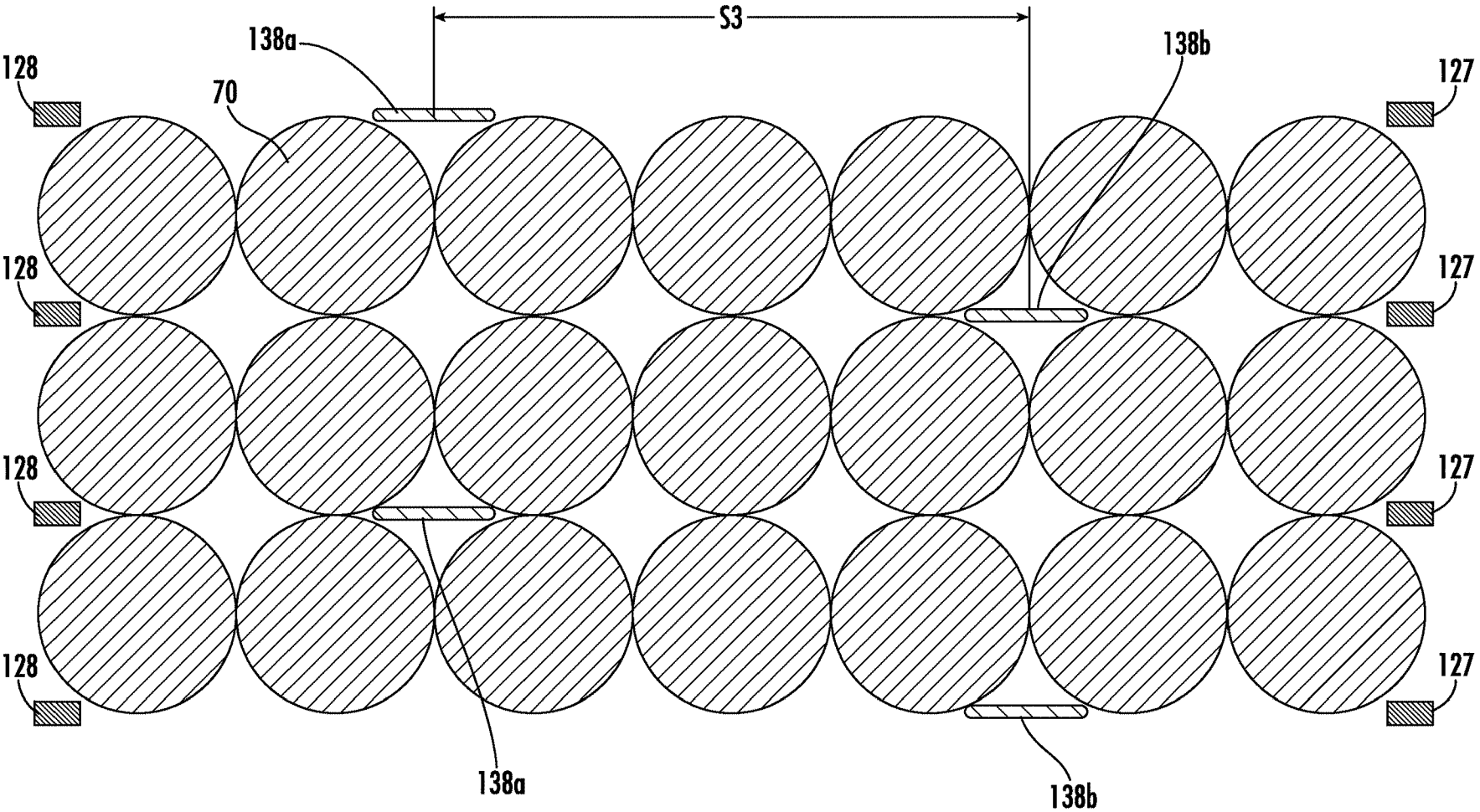
FIG. 16 illustrates a top view of a partial cross-section through an alternate embodiment of the product management display system of FIG. 13 with product placed in the system.

FIGS. 15 and 16 illustrate a partial cross-section of the system 100 where the cross-section is located parallel to and offset from the floor 116 a minimal amount. As shown, the plurality of bottles 70 secured by the system 100 may have a diameter near the bottom of each bottle 70 may be in contact with the bottle in the adjacent row of the tray 112. The position of the support column 138 may be located in the scalloped region of the bottles when the bottles 70 are at rest within the tray. For instance, the support column 138*a* is located in the scalloped region between the bottles closer to the rear support post 128 of the tray 112, while support column 138*b* is located in the scalloped region between the bottles closer to the forward end of the tray 112. Each support column 138*a*, 138*b* may contact one or more bottles 70 positioned adjacent to each support column 138*a*, 138*b*. The support columns 138*a*, 138*b* may be spaced away in a front to rear direction from each other by a distance, S3. The distance, S3, may be defined as the difference between S1 and S2 and may be greater than or equal to a distance of approximately two bottle diameters as shown in FIG. 15, or a distance greater than or equal to approximately three bottle diameters as shown in FIG. 16. The distances, S1, S2, and S3 may be measured to the center of each support column 138.

The spacing of the staggered positioning of the support columns 138 combined with the bottom surface 122 of each divider 118 being spaced from the floor 116 creates and opening between the divider 118 and the floor 116 of the tray and further forms a wide aperture for the bottles 70 to move within the rows of the tray 112. Because each support column 138 is only positioned at a single location of each row, the divider 118 on the opposite side of the row is open across from each support column 138. The absence of the support column 138 may create a localized region that is more flexible to allow the divider on the opposite side of the row from each support column 138 to flex slightly to provide additional space to allow the bottles to move forward when one of the bottles is removed. For example, as the forwardmost bottle is removed from a row, the trackless pusher mechanism 114 exerts a force to push the remaining bottles in the row forward until the forwardmost bottle contacts the product retaining member 144. Thus, as the pusher exerts a force on the bottles 70, the bottles may slide relative to the bottle in the adjacent row to move forward to the next position.

Each support column 138 may be sized to provide the additional required stiffness to support the divider 118 under the loading conditions, while also being dependent upon the diameter of the bottles 70. For example, the support column 138 may have a width of approximately 1.50 inches, or within a range of 1.375 inches to 1.625 inches. The divider wall 119 may be approximately 0.11 inches thick, or within a range of 0.10 inches to 0.120 inches. In addition, the plurality of dividers 118 may be formed using a molding process, such as injection molding, and may be formed of a polymeric material, such as polypropylene.

As an alternative embodiment, the support columns 138 may be removed from the dividers 118. This would leave each divider 118 supported only by its connection to the front support column 127 and rear support column 128. As the thickness of the divider wall 119 may be limited by the size of the bottles 70 placed in the system 100, if the size of the bottles 70 is reduced, the thickness of the divider wall 119 may be increased to increase the overall stiffness of each divider 118 to avoid the issues caused by splay. As another option, the stiffness of the each divider 118 may be increased by changing the material to a stiffer polymer, such as a fiber reinforced polymer, or unfilled polymer such as a polycarbonate, or nylon. As another option, the divider 118 may be formed from a metallic material, such as aluminum or steel.

Variations and modifications of the foregoing are within the scope of the present invention. For example, one of skill in the art will understand that multiples of the described components may be used in stores and in various configurations. The present invention is therefore not to be limited to a single system, nor the upright pusher configuration, depicted in the Figures, as the system is simply illustrative of the features, teachings and principles of the invention. It should further be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. This disclosure is described to cover any and all modifications and forms which may come within the language and scope of the appended claims.

What is claimed is:

1. A product management display system comprising:

a tray having a front end, a rear end, and a floor configured to support a plurality of product, wherein the floor includes a plurality of grooves, and wherein the floor defines a rounded end portion at the front end of the tray and at the rear end of the tray;

a plurality of divider walls, wherein each divider wall of the plurality of divider walls separates the tray into a product dispensing row;

a forward retaining member, wherein the forward retaining member extends between a pair of forward support posts and extends beyond the rounded end portion at the front end of the tray, wherein the forward retaining member and the pair of forward support posts are formed as a unitary component, wherein the forward retaining member and the pair of forward support posts are transparent, and wherein the unitary forward retaining member and the pair of forward support posts are configured to engage the tray;

a pair of rearward support posts positioned at the rear end of the tray; and a rear retaining member, wherein the rear retaining member extends between the pair of rearward support posts and extends beyond the rounded end portion at the rear end of the tray.

2. The product management display system of claim 1, wherein the forward retaining member is curved.

3. The product management display system of claim 1, wherein the forward retaining member and the pair of forward support posts are formed separately from the tray and the dividers.

4. The product management display system of claim 1, wherein the pair of forward support posts are straight.

5. The product management display system of claim 1, wherein the dividers include a plurality of support columns.

6. The product management display system of claim 1, wherein the plurality of grooves are evenly spaced.

7. The product management display system of claim 1 further comprising at least one pusher mechanism configured to move product toward the front end of the tray within the product dispensing row.

8. A product management display system comprising:

a tray having a front end, a rear end, and a floor configured to support a plurality of product, wherein the floor includes a plurality of grooves, and wherein the floor defines a rounded end portion at the front end of the tray;

a plurality of divider walls, wherein each divider wall of the plurality of divider walls separates the tray into a product dispensing row;

a forward retaining member, wherein the forward retaining member extends between a pair of forward support posts and extends beyond the rounded end portion, wherein the forward retaining member and the pair of forward support posts are formed as a unitary component, wherein the forward retaining member and the pair of forward support posts are transparent, and wherein the unitary forward retaining member and the pair of forward support posts are configured to engage the tray;

a pair of rearward support posts positioned at the rear end of the tray;

a rear retaining member, wherein the rear retaining member extends between the pair of rearward support posts, wherein the rear retaining member and the pair of rearward support posts are formed as a unitary component; and a plurality of pusher mechanisms configured to move product toward the front end of the tray within the product dispensing rows, and wherein each divider wall of the plurality of divider walls is disposed in a groove formed in at least one of the pair forward support posts and the pair of rearward support posts.

9. The product management display system of claim 8, wherein the forward retaining member is curved.

10. The product management display system of claim 8, wherein the forward retaining member and the pair of forward support posts are formed separately from the tray and the dividers.

11. The product management display system of claim 8, wherein the pair of forward support posts are straight.

12. The product management display system of claim 8, wherein the dividers include a plurality of support columns.

13. The product management display system of claim 8, wherein the plurality of grooves are evenly spaced.

14. A product management display system comprising:

a tray having a front end, a rear end, and a floor configured to support a plurality of product, wherein the floor includes a plurality of grooves, and wherein the floor defines a rounded end portion at the front end of the tray;

a plurality of divider walls, wherein each divider wall of the plurality of divider walls separates the tray into a product dispensing row wherein the divider walls are arranged to laterally shift when contacted by one of the plurality of product;

a forward retaining member, wherein the forward retaining member extends between a pair of forward support posts and extends beyond the rounded end portion, wherein the forward retaining member and the pair of forward support posts are transparent, and wherein the unitary forward retaining member and the pair of forward support posts are configured to engage the tray such that the forward retaining member, the pair of forward support posts, and the tray define a forward opening through which product is accessible;

a pair of rearward support posts positioned at the rear end of the tray;

a rear retaining member, wherein the rear retaining member extends between the pair of rearward support posts, and wherein the rear retaining member and the pair of rearward support posts are configured to engage the tray such that the rear retaining member, the pair of rearward support posts, and the tray define a rearward opening through which product is accessible; and at least one pusher mechanism configured to move product toward the front end of the tray within the product dispensing rows.

15. The product management display system of claim 14, wherein the pair of forward support posts are formed as a unitary component.

16. The product management display system of claim 14, wherein the forward retaining member is curved.

17. The product management display system of claim 14, wherein the forward retaining member and the pair of forward support posts are formed separately from the tray and the dividers.

18. The product management display system of claim 14, wherein the pair of forward support posts are straight.

19. The product management display system of claim 14, wherein the dividers include a plurality of support columns.

20. The product management display system of claim 14, wherein the plurality of grooves are evenly spaced.

* * * * *